US010258163B2

(12) United States Patent
Stickler

(10) Patent No.: US 10,258,163 B2
(45) Date of Patent: Apr. 16, 2019

(54) MATTRESS PERMITTING AIRFLOW FOR HEATING AND COOLING

(71) Applicant: ASHLEY FURNITURE INDUSTRIES, INC., Arcadia, WI (US)

(72) Inventor: Stephen R. Stickler, Oak Ridge, NC (US)

(73) Assignee: Ashley Furniture Industries, Inc., Arcadia, WI (US)

( * ) Notice: Subject to any disclaimer, the term of this patent is extended or adjusted under 35 U.S.C. 154(b) by 0 days.

(21) Appl. No.: 15/479,165

(22) Filed: Apr. 4, 2017

(65) Prior Publication Data

US 2017/0295945 A1 Oct. 19, 2017

Related U.S. Application Data

(60) Provisional application No. 62/318,006, filed on Apr. 4, 2016.

(51) Int. Cl.

| | |
|---|---|
| ***A47C 21/00*** | (2006.01) |
| ***A47C 21/04*** | (2006.01) |
| ***A47C 27/00*** | (2006.01) |
| ***A47C 27/14*** | (2006.01) |
| ***A47C 27/15*** | (2006.01) |

(52) U.S. Cl.

CPC ..... *A47C 21/046* (2013.01); *A47C 27/002* (2013.01); *A47C 27/148* (2013.01); *A47C 27/15* (2013.01)

(58) Field of Classification Search

CPC ..... A47C 21/00; A47C 21/04
USPC ..... 5/421, 423, 426, 505.1 B, 652.2, 505.1
See application file for complete search history.

(56) References Cited

U.S. PATENT DOCUMENTS

| | | | | |
|---|---|---|---|---|
| 3,266,064 | A * | 8/1966 | Figman | A47C 21/044 5/284 |
| 5,887,304 | A * | 3/1999 | von der Heyde | A47C 21/044 5/423 |
| 6,052,853 | A | 4/2000 | Schmid | |
| 6,336,237 | B1 | 1/2002 | Schmid | |
| 6,370,718 | B1 | 4/2002 | Schmid | |
| 7,037,188 | B2 | 5/2006 | Schmid et al. | |
| 7,127,763 | B1 | 10/2006 | Schmid et al. | |
| 7,240,386 | B1 | 7/2007 | McKay et al. | |
| 7,334,280 | B1 | 2/2008 | Swartzburg | |
| 7,877,827 | B2 | 2/2011 | Marquette et al. | |
| 7,914,611 | B2 | 3/2011 | Vrzalik et al. | |

(Continued)

OTHER PUBLICATIONS

International Search Report and Written Opinion, dated Jun. 16, 2017, 24 pages.

*Primary Examiner* — Fredrick C Conley
(74) *Attorney, Agent, or Firm* — Christensen, Fonder, Dardi & Herbert PLLC

(57) ABSTRACT

A mattress configured for placement on a foundation that has forced air ventilation with a plurality of air vents on the upwardly facing side of the foundation. The foundation providing a first flow of air having a first temperature and a second flow of air having a second temperature, the mattress defining a first plurality of air flow paths configured to direct the first flow of air toward a first occupant of the mattress and a second plurality of air flow paths configured to direct the second flow of air toward a second occupant of the mattress. The mattress being configured so that air from the air vents is permitted to pass through the mattress.

20 Claims, 16 Drawing Sheets

(56) References Cited

U.S. PATENT DOCUMENTS

| | | | | |
|---|---|---|---|---|
| 7,996,936 | B2 | 8/2011 | Marquette et al. | |
| 8,065,763 | B2 | 11/2011 | Brykalski et al. | |
| 8,181,290 | B2 | 5/2012 | Brykalski et al. | |
| 8,191,187 | B2 | 6/2012 | Brykalski et al. | |
| 8,332,975 | B2 | 12/2012 | Brykalski et al. | |
| 8,372,182 | B2 | 2/2013 | Vrzalik et al. | |
| 8,402,579 | B2 | 3/2013 | Marquette et al. | |
| 8,408,012 | B2 | 4/2013 | Goenka et al. | |
| 8,418,286 | B2 | 4/2013 | Brykalski et al. | |
| 8,424,314 | B2 | 4/2013 | Mazet | |
| 8,424,315 | B2 | 4/2013 | Goenka | |
| RE44,272 | E | 6/2013 | Bell | |
| 8,621,687 | B2 | 1/2014 | Brykalski et al. | |
| 8,732,874 | B2 | 5/2014 | Brykalski et al. | |
| 8,782,830 | B2 | 7/2014 | Brykalski et al. | |
| 8,881,328 | B2 | 11/2014 | Mikkelsen et al. | |
| 8,893,329 | B2 | 11/2014 | Petrovski et al. | |
| 8,918,930 | B2 | 12/2014 | Stroh et al. | |
| 8,997,279 | B1 | 4/2015 | McKay et al. | |
| 9,121,414 | B2 | 9/2015 | Lofy et al. | |
| 9,125,497 | B2 | 9/2015 | Brykalski et al. | |
| 9,138,064 | B2 | 9/2015 | Tursi, Jr. et al. | |
| 9,192,245 | B2 | 11/2015 | Chunglo | |
| 9,211,017 | B2 | 12/2015 | Tyree | |
| 9,265,352 | B2 | 2/2016 | Oakhill et al. | |
| 9,596,945 | B2 * | 3/2017 | Ghanei ..... | A47C 21/044 |
| 2006/0080778 | A1 | 4/2006 | Chambers | |
| 2011/0296611 | A1 | 12/2011 | Marquette et al. | |
| 2013/0097776 | A1 | 4/2013 | Brykalski et al. | |
| 2014/0310874 | A1 | 10/2014 | Brykalski et al. | |

* cited by examiner

MATTRESS PERMITTING AIRFLOW FOR HEATING AND COOLING

RELATED APPLICATIONS

This application claims the benefit of U.S. Provisional Patent Application No. 62/318,006, filed Apr. 4, 2016, the disclosure of which is incorporated by reference herein in its entirety.

BACKGROUND OF THE DISCLOSURE

It has been estimated that nearly one third of Americans are sleep deprived. Sleep is primarily a restorative process that influences the homeostatic regulation of the autonomic, neuroendocrine and immune systems of the human body. The quantity and quality of a person's sleep are both important factors in maintaining good health. Without proper sleep, people are more susceptible to illnesses, have a lower frustration tolerance and may tend to overreact when stresses occur in their lives, and have diminished capacities to concentrate, remember, learn and complete tasks. Thousands die each year in automobile accidents resulting when someone falls asleep at the wheel. There is even evidence that without proper sleep aspects of the aging process are accelerated and may shorten life span.

In order to achieve quality sleep, a person needs to make himself or herself as comfortable as possible. Accordingly, a comfortable mattress is an important factor in achieving quality sleep. Temperature is an additional important factor in achieving quality sleep. If the ambient air temperature is too warm, a person may have difficulty falling asleep and may be restless once he or she has fallen asleep. If the ambient air temperature is too cold, a person may dress warmly for bed and using multiple blankets. One common experience is that an amount of insulation that initially felt comfortably warm suddenly becomes unbearably hot. When this happens, physical effort to remove layers of insulation may be required again achieve a comfortable balance. Another common experience is the unconscious act of kick off blankets while sleeping and then waking up feeling cold.

An additional challenge to achieving a comfortable temperature for sleep is that fact that two people often sleep in the same room and on the same mattress. The ambient air temperature that is comfortable for one person may be too hot or too cold for that person's companion. A system providing a comfortable sleeping environment for two occupants of the mattress would be desirable. A system allowing a person occupying the port side of the bed to select a first temperature and, at the same time, allowing a person occupying the starboard side of the bed to select a second temperature different from the first temperature would also be desirable.

SUMMARY

In one or more embodiments of the invention, a mattress is configured for placement on a foundation that has forced air ventilation with a plurality of air vents on the upwardly facing side of the foundation. The mattress is configured so that air from the air vents is permitted to pass through the mattress. The mattress comprises a base including a base layer and a transition layer bonded to the base layer by a layer of adhesive. The base layer comprises a polyurethane memory foam having a first density and the transition layer comprises a polyurethane memory foam having a second density that is less than the first density. The base defines two or more port-side flow channels located in a port portion of the base. Each port-side flow channel extends between an opening in a bottom surface of the base and an opening in a top surface of the base. The base defines two or more starboard flow channels located in a starboard portion of the base. Each starboard flow channel extends between an opening in the bottom surface of the base and an opening the top surface of the base.

The mattress includes a diffusing layer overlaying the top surface of the base. The diffusing layer is divided in the lengthwise direction by a dividing member so that the diffusing layer comprises a port diffusing member, a starboard diffusing member, and the dividing member disposed between the port diffusing member and the starboard diffusing member. The port diffusing member comprises a cellular structure defining a plurality of cells. The cells of the port diffusing member are disposed in fluid communication with each other to form a port volume defined by the cellular structure of the port diffusing member. The port volume defined by the cellular structure of the port diffusing member is in fluid communication with the port flow channels defined by the base. The starboard diffusing member comprises a cellular structure defining a plurality of cells. The cells of the starboard diffusing member are disposed in fluid communicating with each other to form a starboard volume defined by the cellular structure of the starboard diffusing member. The starboard volume defined by the cellular structure of the starboard diffusing member is in fluid communication with the starboard flow channels defined by the base.

In one or more embodiments, the dividing member comprises a closed cell foam material disposed between the port diffusing member and the starboard diffusing member so that the port volume does not fluidly communicate with the starboard volume through the dividing member. In one or more embodiments, the dividing member, the port diffusing member and the starboard diffusing member each having a height of between 1 inch and 3 inches.

In one or more embodiments, the mattress includes a diffusing fabric that is positioned to overlay the diffusing layer. The diffusing fabric defines a multiplicity of connected interstitial spaces. In one or more embodiments, the interstitial spaces are dimensioned and configured to allow air to flow through the diffusing fabric.

In one or more embodiments, the mattress includes a comfort layer overlaying the diffusing fabric. In one or more embodiments, the comfort layer comprises a Talalay latex foam having a thickness dimension with a value between 1 inch and 3 inches. In one or more embodiments, the comfort layer defines a pattern of vertically extending bore holes and each vertically extending bore hole has a diameter of at least 0.20 inches. In one or more embodiments, each vertically extending bore hole has a diameter of at least 0.30 inches. In one or more embodiments, each vertically extending bore hole has a diameter of at least 0.40 inches. In one or more embodiments, each vertically extending bore hole defined by a port portion of the comfort layer fluidly communicates with the port volume defined by the port diffusing member via interstitial spaces defined by the diffusing fabric. In one or more embodiments, each vertically extending bore hole defined by a starboard portion of the comfort layer fluidly communicates with the starboard volume defined by the starboard diffusing member via interstitial spaces defined by the diffusing fabric.

In one or more embodiments, the mattress includes a cover layer positioned to overlay the comfort layer. In one or more embodiments, the cover layer comprises a first woven fabric, a second woven fabric, and a matt of non-woven fibers disposed between the first woven fabric and the second woven fabric. In one or more embodiments, the first woven fabric comprises plurality of woven fibers and the first woven fabric is coated with a phase changing gel material.

In one or more embodiments, the mattress defines a plurality of port-side air flow paths that extend through the mattress. In one or more embodiments, each of the port-side airflow paths extends through one of the port airflow channels defined by the base, the port volume defined by the cellular structure of the port diffusing member, the interstitial spaces defined by the diffusing fabric, and one of the vertically extending bore holes defined by the port portion of the comfort layer. In one or more embodiments, the mattress defines a plurality of starboard-side air flow paths extending through the mattress. In one or more embodiments, each of the starboard-side airflow paths extends through one of the starboard airflow channels defined by the base, the starboard volume defined by the cellular structure of the starboard diffusing member, the interstitial spaces defined by the diffusing fabric, and one of the vertically extending bore holes defined by the starboard portion of the comfort layer.

A feature and advantage of embodiments is a mattress configured to work in conjunction with a foundation that has forced air ventilation with a plurality of air vents on the upward facing side of the foundation. A feature and advantage of embodiments is a mattress configured to permit air from air vents of the foundation to pass through the mattress.

A feature and advantage of embodiments is a mattress that is permeable to air flow provided by a forced air ventilation unit. A feature and advantage of embodiments is a mattress configured to allow air from the forced air ventilation unit to pass through with high efficiency and low-pressure drop. A feature and advantage of embodiments is a system that increases the comfort of the user by heating and/or cooling of the air before the air passes through the mattress.

A feature and advantage of embodiments is a system that allows the person occupying the port side of a bed to select a flow of air having one temperature and, at the same time, allows the person occupying the starboard side of the bed to select a flow of air having another temperature different from the first mentioned temperature. The system may include a mattress configured to reduce or prevent mixing of air passing through the port side portion of the mattress with air passing through the starboard side portion of the mattress.

A feature and advantage of embodiments is a system that provides a level of airflow sufficient to prevent the accumulation of carbon dioxide in the area surrounding the occupant of a bed. A feature and advantage of embodiments is a system that provides a level of airflow sufficient to prevent the accumulation of carbon dioxide in bedding.

In one or more embodiments, the polyurethane memory foam of the base layer has a density no less than about 20 kg/m3 and no greater than about 200 kg/m3, the density being measured using the method described in ASTM D3574-2011. In one or more embodiments, the polyurethane memory foam of the base layer has a density no less than about 30 kg/m3 and no greater than about 175 kg/m3. In one or more embodiments, the polyurethane memory foam of the base layer has a density no less than about 40 kg/m3 and no greater than about 150 kg/m3.

In one or more embodiments, the polyurethane memory foam of the base layer has a hardness no less than about 10 N and no greater than about 300 N, the hardness being measured using the indentation force deflection method described in ASTM D3574-2011. In one or more embodiments, the polyurethane memory foam of the base layer has a hardness no less than about 20 N and no greater than about 200 N. In one or more embodiments, the polyurethane memory foam of the base layer has a hardness no less than about 30 N and no greater than about 100 N.

In one or more embodiments, the polyurethane memory foam of the base layer comprises a closed cell foam material. In one or more embodiments, the Talalay latex foam of the comfort layer comprises a closed cell foam material. In one or more embodiments, the cellular structure of the port diffusing member comprises an open cell, reticulated polyurethane foam structure. In one or more embodiments, the cellular structure of the starboard diffusing member comprises an open cell reticulated polyurethane foam structure.

In one or more embodiments, the diffusing fabric spans continuously across a top surface of the diffusing layer. In one or more embodiments, the diffusing fabric comprises a plurality of fabric patches that do not span across a top surface of the diffusing layer. For example, one fabric patch may be positioned above each of the flow channels defined by the base. In one or more embodiments, the diffusing layer spans continuously across the top surface of the base.

DETAILED DESCRIPTION

Figure 1:
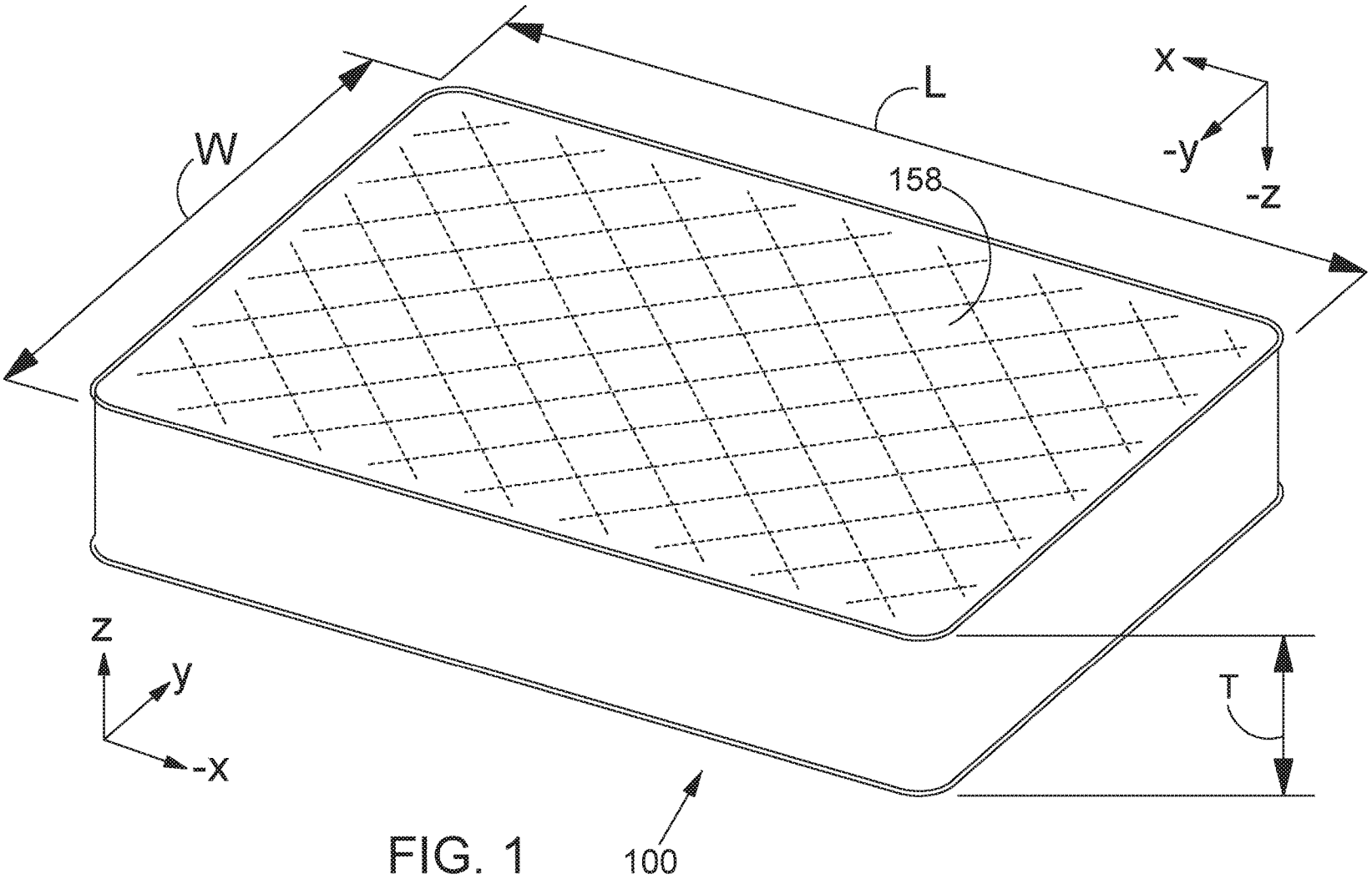
FIG. 1 is a perspective view of a mattress including a fabric covering.
Figure 13:
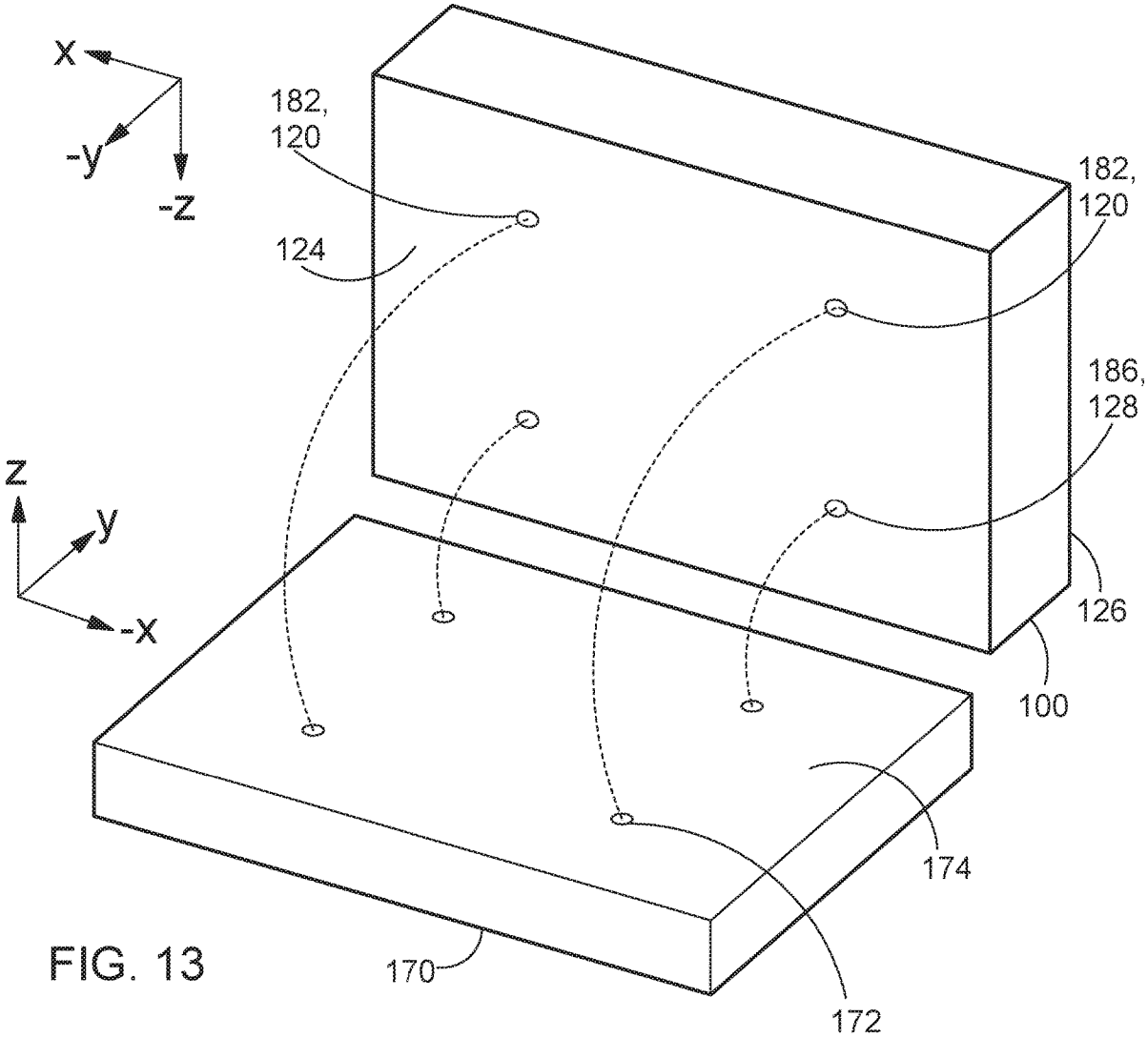
FIG. 13 is an exploded perspective view showing a mattress and a foundation.

Referring to FIG. 1 and FIG. 13, in one or more embodiments of the invention, a mattress 100 is configured for placement on a foundation 170 that has forced air ventilation with a plurality of air vents 172 on the upwardly facing side 174 of the foundation 170. In the embodiment shown in FIG. 13, the mattress 100 is configured so that port-side flow channels 120 and starboard flow channels 128 of the mattress 100 align with the plurality of air vents 172 on the upwardly facing side 174 of the foundation 170. In one or more embodiments, the mattress 100 is configured so that air from the air vents of the forced air ventilation system is permitted to pass through the mattress 100.

Figure 2:
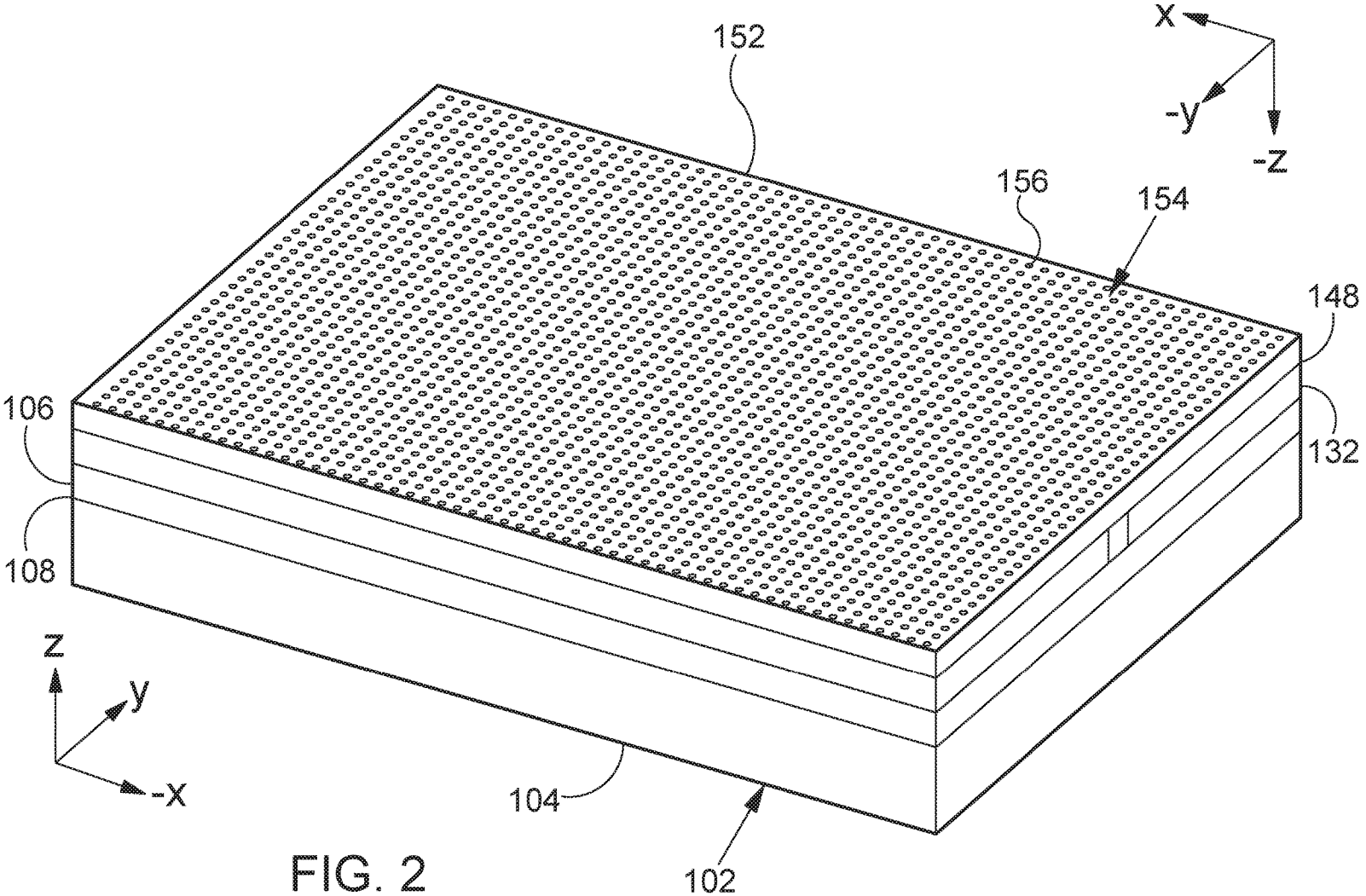
FIG. 2 is a perspective view showing an inner assembly of the mattress shown in FIG. 1. In the embodiment of FIG. 2, the fabric covering of mattress has been removed so that the inner assembly is visible.
Figure 3:
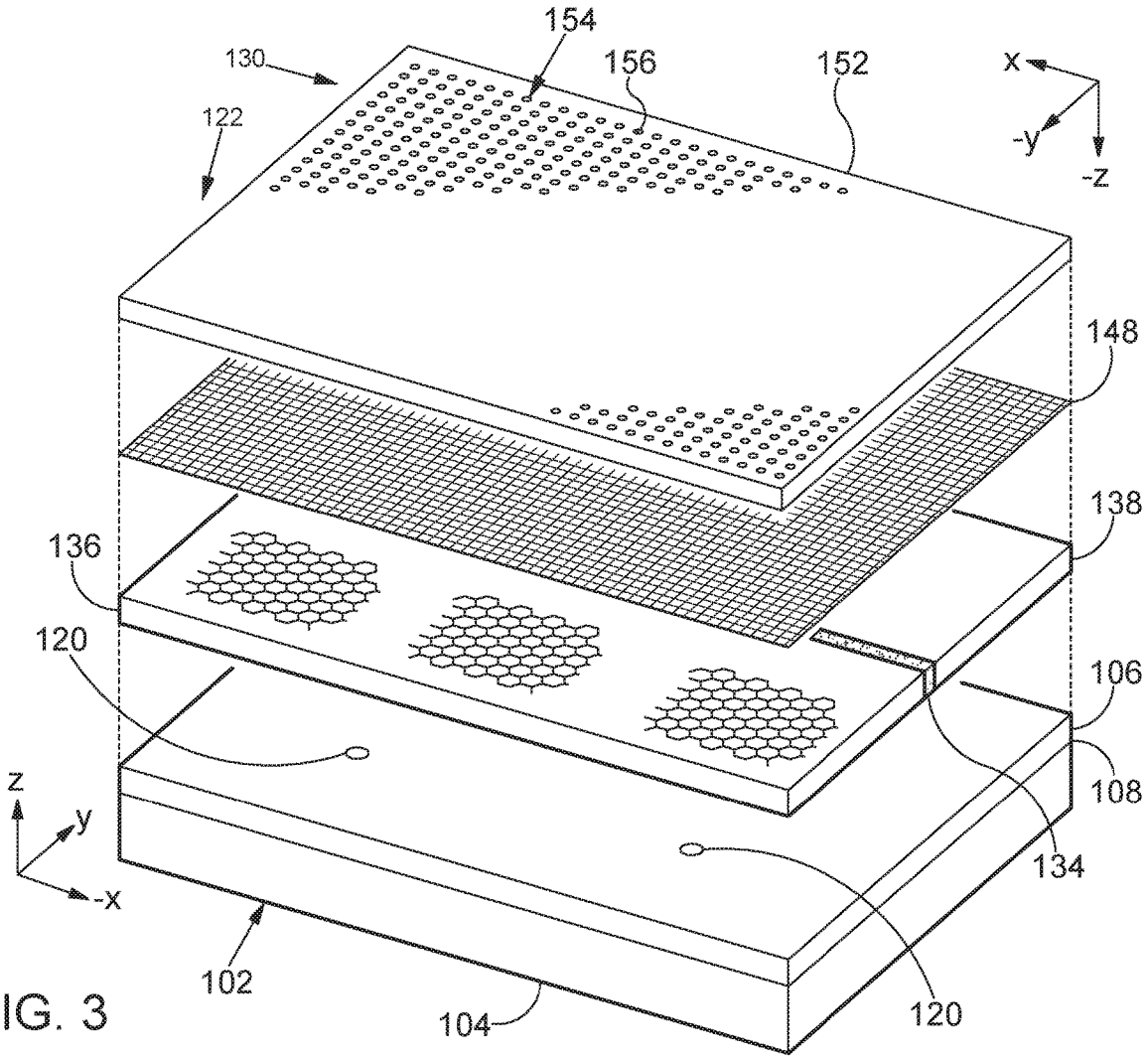
FIG. 3 is an exploded perspective view of the assembly shown in FIG. 2.
Figure 4:
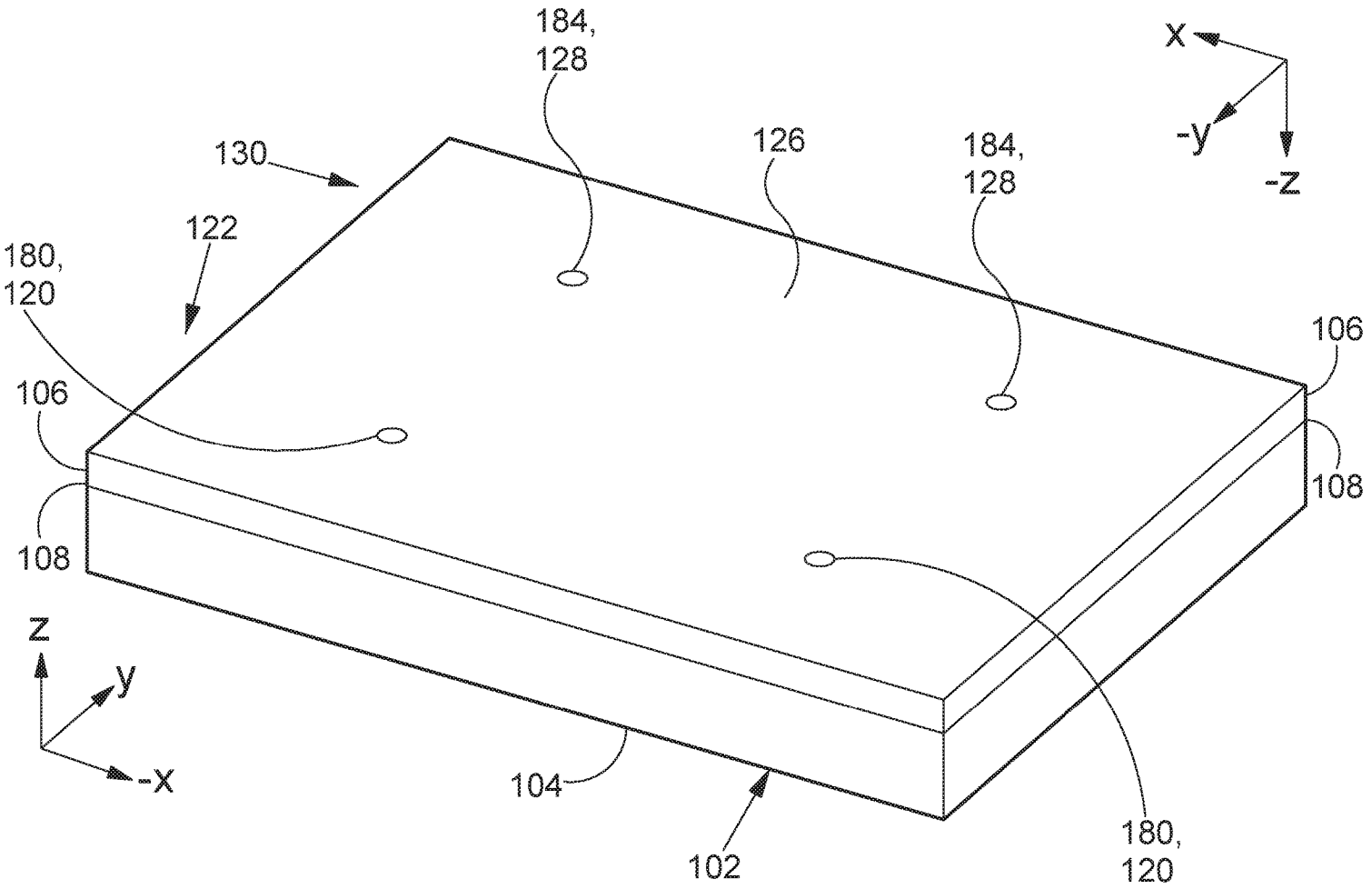
FIG. 4 is a perspective view of a base comprising a base layer and a transition layer that is bonded to the base layer by a layer of adhesive.

Referring to FIG. 2, FIG. 3 and FIG. 4, the mattress 100 comprises a base 102 including a base layer 104 and a transition layer 106 that is bonded to the base layer 104 by a layer of adhesive 108. In one or more embodiments, the base layer 104 comprises a polyurethane memory foam having a first density and the transition layer comprises a polyurethane memory foam having a second density that is less than the first density. The base 102 defines two port-side flow channels 120 located in a port portion 122 of the base 102. Each of the port-side flow channels 120 extends between an opening in a bottom surface of the base and an opening in a top surface 126 of the base 102. The base also defines two starboard flow channels 128 located in a starboard portion 130 of the base 102. Each of the starboard flow channels 128 extends between an opening in the bottom surface of the base and an opening in the top surface 126 of the base 102.

Referring to FIGS. 2, 3, 5, 6, 7A and 7B, the mattress 100 includes a diffusing layer 132 that is positioned to overlay the top surface 126 of the base 102. The diffusing layer 132 is divided in the a lengthwise direction by a dividing member 134 so that the diffusing layer 132 comprises a port diffusing member 136, a starboard diffusing member 138, and the dividing member 134 disposed between the port diffusing member 136 and the starboard diffusing member 138. The port diffusing member 136 comprises a cellular structure 140 defining a plurality of cells 142. The cells 142 of the port diffusing member 136 are disposed in fluid communication with each other to form a port volume 144 defined by the cellular structure 140 of the port diffusing member 136. The port volume 144 defined by the cellular structure 140 of the port diffusing member 136 is in fluid communication with the port-side flow channels 120 defined by the base 102. The starboard diffusing member 138 comprises a cellular structure 140 defining a plurality of cells 142. The cells 142 of the starboard diffusing member 138 are disposed in fluid communicating with each other to form a starboard volume 146 defined by the cellular structure 140 of the starboard diffusing member 138. The starboard volume 146 defined by the cellular structure 140 of the starboard diffusing member 138 is in fluid communication with the starboard flow channels 128 defined by the base 102. In one or more embodiments, the dividing member comprises a closed cell foam material disposed between the port diffusing member and the starboard diffusing member so that the port volume does not fluidly communicate with the starboard volume through the dividing member. In one or more embodiments, the dividing member, the port diffusing member and the starboard diffusing member each having a height T of between 1 inch and 3 inches.

Figure 15:
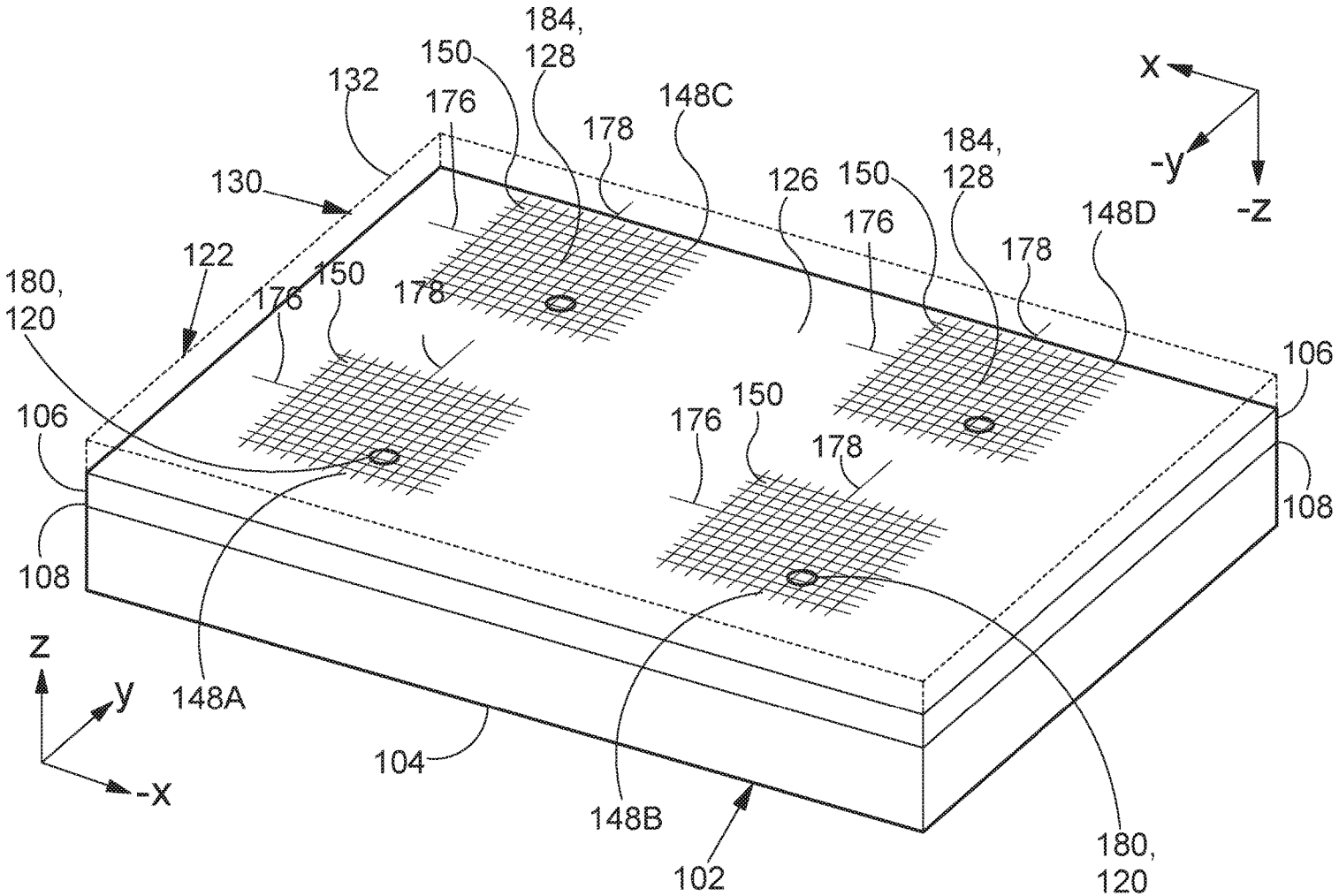
FIG. 15 is a perspective view of a base comprising a base layer and a transition layer that is bonded to the base layer by a layer of adhesive. In the embodiment of FIG. 15, one fabric patch of a diffusing fabric is positioned above each of the flow channels defined by the base. A diffusing layer 132 is shown with dashed lines in FIG. 15. In the embodiment of FIG. 15, the diffusing layer 132 is disposed between the fabric patches of diffusing fabric positioned above each of the flow channels defined by the base. In the embodiment of FIG. 15, the diffusing fabric comprises a plurality of fabric patches that do not span across a top surface of the diffusing layer.
Figure 16:
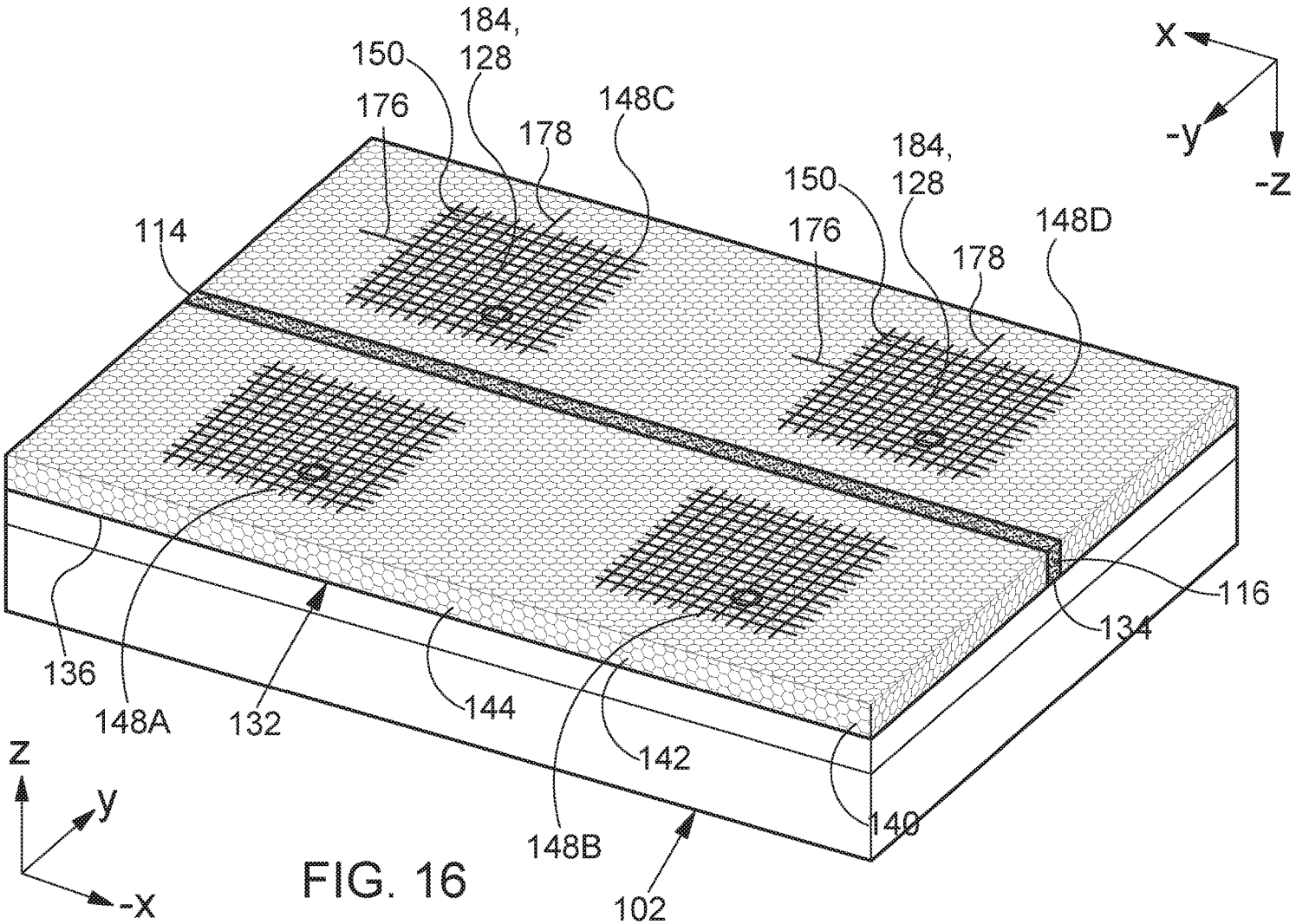
FIG. 16 is a perspective view of a base comprising a base layer and a transition layer that is bonded to the base layer by a layer of adhesive. In the embodiment of FIG. 16, one fabric patch of a diffusing fabric is positioned above each of the flow channels defined by the base. A diffusing layer 132 also shown in FIG. 16. In the embodiment of FIG. 16, the diffusing layer 132 is disposed between the fabric patches of diffusing fabric positioned above each of the flow channels defined by the base. In the embodiment of FIG. 16, the diffusing fabric comprises a plurality of fabric patches that do not span across a top surface of the diffusing layer.

Referring to FIGS. 2, 3, 8A and 8B, the mattress 100 includes a diffusing fabric 148 that is positioned to overlay the diffusing layer 132. The diffusing fabric 148 defines a multiplicity of connected interstitial spaces 150. In one or more embodiments, the interstitial spaces 150 are dimensioned and configured to allow air to flow through the diffusing fabric 148. Referring to FIGS. 15 and 16, in one or more embodiments, the diffusing fabric comprises a plurality of fabric patches that do not span across a top surface of the diffusing layer. For example, one fabric patch may be positioned above each of the flow channels defined by the base.

Referring to FIGS. 2, 3, 9A, 9B, and 10, the mattress 100 includes a comfort layer 152 overlaying the diffusing fabric 148. In one or more embodiments, the comfort layer 152 comprises a Talalay latex foam having a thickness dimension with a value between 1 inch and 3 inches. As shown in the figures, the comfort layer 152 defines a pattern 154 of vertically extending bore holes 156. In one or more embodiments, each of the vertically extending bore holes has a diameter of at least 0.20 inches. In one or more embodiments, each of the vertically extending bore holes 156 has a diameter of at least 0.30 inches. In one or more embodiments, each of the vertically extending bore holes 156 has a diameter of at least 0.40 inches. In one or more embodiments, each of the vertically extending bore holes defined in a port portion 122 of the comfort layer 152 fluidly communicates with the port volume 144 defined by the port diffusing member 136 via interstitial spaces 150 defined by the diffusing fabric 148. In one or more embodiments, each of the vertically extending bore holes 156 defined in a starboard portion 130 of the comfort layer 152 fluidly communicates with the starboard volume 146 defined by the starboard diffusing member 138 via interstitial spaces 150 defined by the diffusing fabric 148.

Referring to FIGS. 1 and 12, the mattress 100 includes a cover layer positioned to overlay the comfort layer 152. In one or more embodiments, the cover layer 158 comprises a first woven fabric 160, a second woven fabric 162, and a matt 164 of non-woven fibers 166 disposed between the first woven fabric 160 and the second woven fabric 162. In one or more embodiments, the first woven fabric 160 comprises plurality of woven fibers and the first woven fabric 160 is coated with a phase changing gel material.

Figure 11:
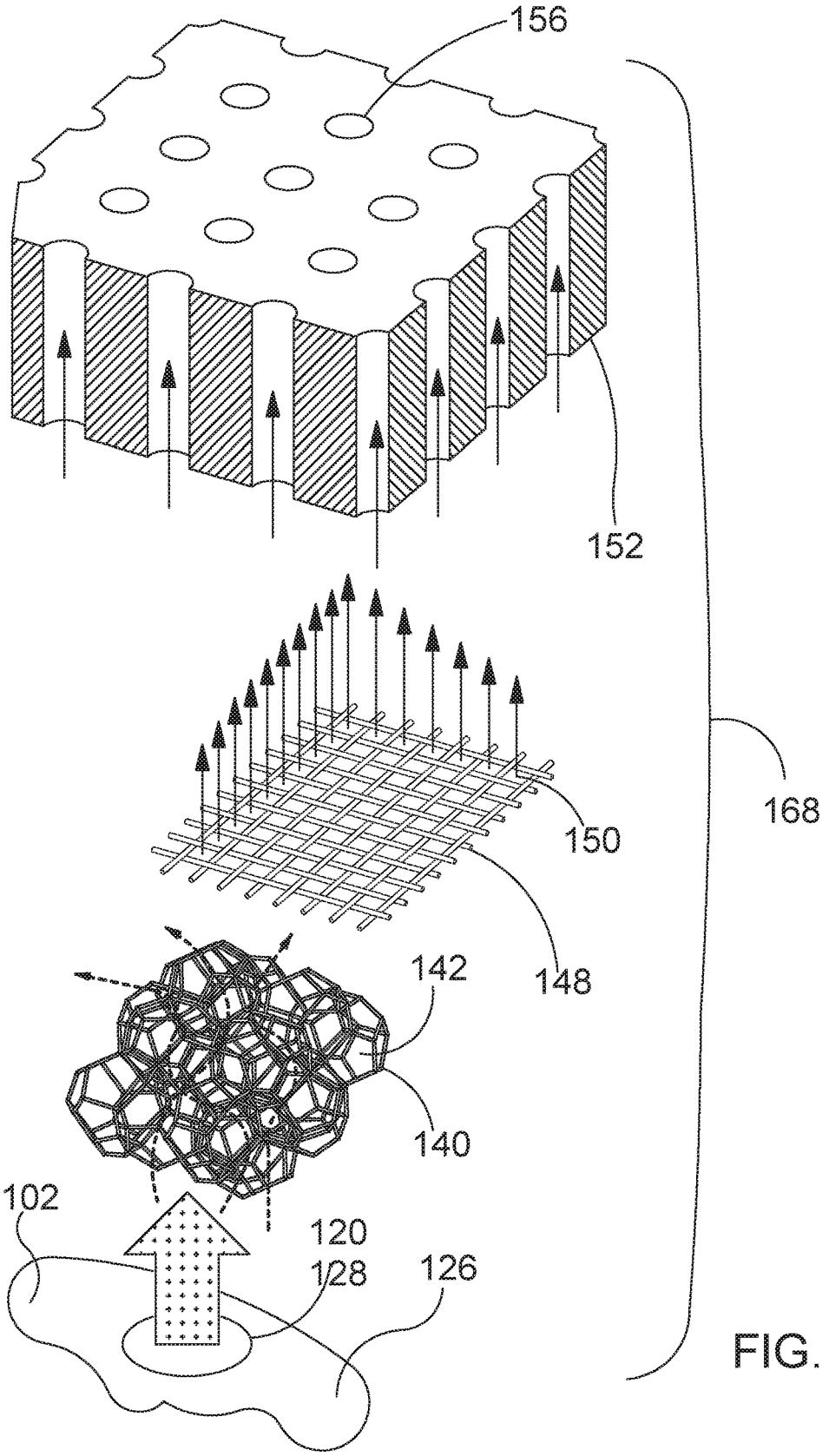
FIG. 11 is a stylized diagram illustrating an example air flow path.

Referring to FIGS. 3 and 11, the mattress 100 defines a plurality of port-side air flow paths 168 that extend through the mattress 100. In one or more embodiments, each of the port-side airflow paths 168 extends through one of the port-side flow channels 120 defined by the base 102, the port volume defined by the cellular structure 140 of the port diffusing member, the interstitial spaces 150 defined by the diffusing fabric 148, and one of the vertically extending bore holes 156 defined by the port portion of the comfort layer 152. In one or more embodiments, the mattress 100 defines a plurality of starboard-side air flow paths 168 extending through the mattress 100. In one or more embodiments, each of the starboard-side airflow paths 168 extends through one of the starboard flow channels 128 defined by the base, the starboard volume 146 defined by the cellular structure 140 of the starboard diffusing member, the interstitial spaces 150 defined by the diffusing fabric 148, and one of the vertically extending bore holes 156 defined by the starboard portion of the comfort layer 152.

Referring to FIGS. 2-4, in one or more embodiments, the polyurethane memory foam of the base layer of the base has a density no less than about 20 kg/m3 and no greater than about 200 kg/m3, the density being measured using the method described in ASTM D3574-2011. In one or more embodiments, the polyurethane memory foam of the base layer has a density no less than about 30 kg/m3 and no greater than about 175 kg/m3. In one or more embodiments, the polyurethane memory foam of the base layer has a density no less than about 40 kg/m3 and no greater than about 150 kg/m3. In one or more embodiments, the polyurethane memory foam of the base layer has a hardness no less than about 10 N and no greater than about 300 N, the hardness being measured using the indentation force deflection method described in ASTM D3574-2011. In one or more embodiments, the polyurethane memory foam of the base layer has a hardness no less than about 20 N and no greater than about 200 N. In one or more embodiments, the polyurethane memory foam of the base layer has a hardness no less than about 30 N and no greater than about 100 N. In one or more embodiments, the polyurethane memory foam of the base layer comprises a closed cell foam material.

Referring to FIGS. 2, 3, 5, 6, 7A and 7B, in one or more embodiments, the cellular structure of the port diffusing member comprises an open cell, reticulated polyurethane foam structure. In one or more embodiments, the cellular structure of the starboard diffusing member comprises an open cell reticulated polyurethane foam structure. In one or more embodiments, the diffusing fabric spans continuously across a top surface of the diffusing layer. In one or more embodiments, the diffusing fabric comprises a plurality of fabric patches that do not span across a top surface of the diffusing layer. For example, one fabric patch may be positioned above each of the flow channels defined by the base. In one or more embodiments, the diffusing layer spans continuously across the top surface of the base. In one or more embodiments, the Talalay latex foam of the comfort layer comprises a closed cell foam material.

FIG. 1 is a perspective view of a mattress 100. The mattress 100 shown in FIG. 1 has an inner assembly and a fabric covering surrounding the inner assembly. The fabric covering includes a top cover layer 158.

FIG. 2 is a perspective view showing an inner assembly of the mattress 100 shown in FIG. 1. In the embodiment of FIG. 2, the fabric covering of mattress 100 has been removed so that the inner assembly is visible.

FIG. 3 is an exploded perspective view of the assembly shown in FIG. 2.

FIG. 4 is a perspective view of a base 102 comprising a base layer 104 and a transition layer 106 that is bonded to the base layer 104 by a layer of adhesive 108.

Figure 5:
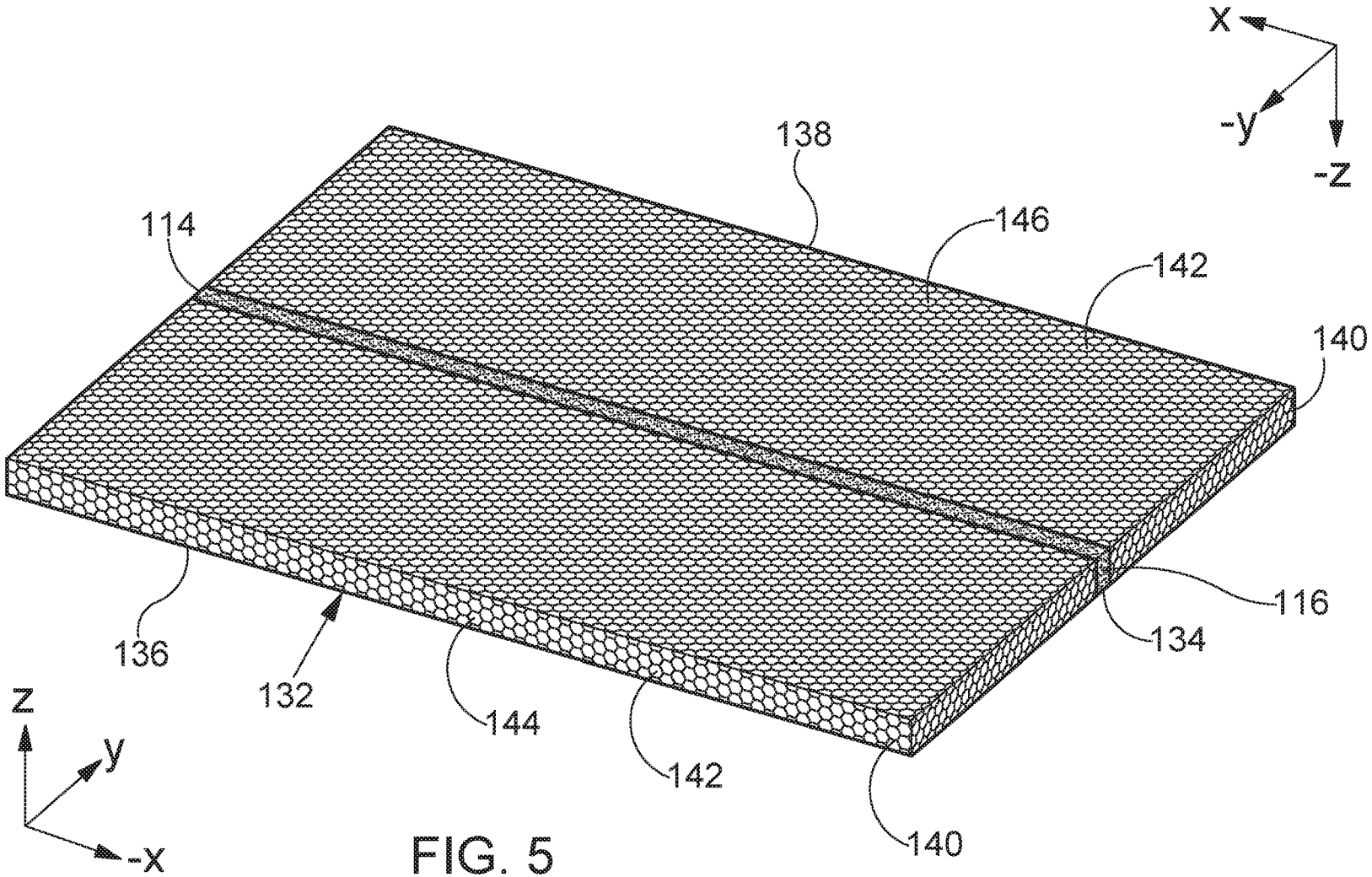
FIG. 5 is a perspective view showing diffusing layer comprising a port diffusing member, a starboard diffusing member, and a dividing member disposed between the port diffusing member and the starboard diffusing member.

FIG. 5 is a perspective view showing diffusing layer 132 comprising a port diffusing member 136, a starboard diffusing member 138, and a dividing member 134 disposed between the port diffusing member 136 and the starboard diffusing member 138.

Figure 6:
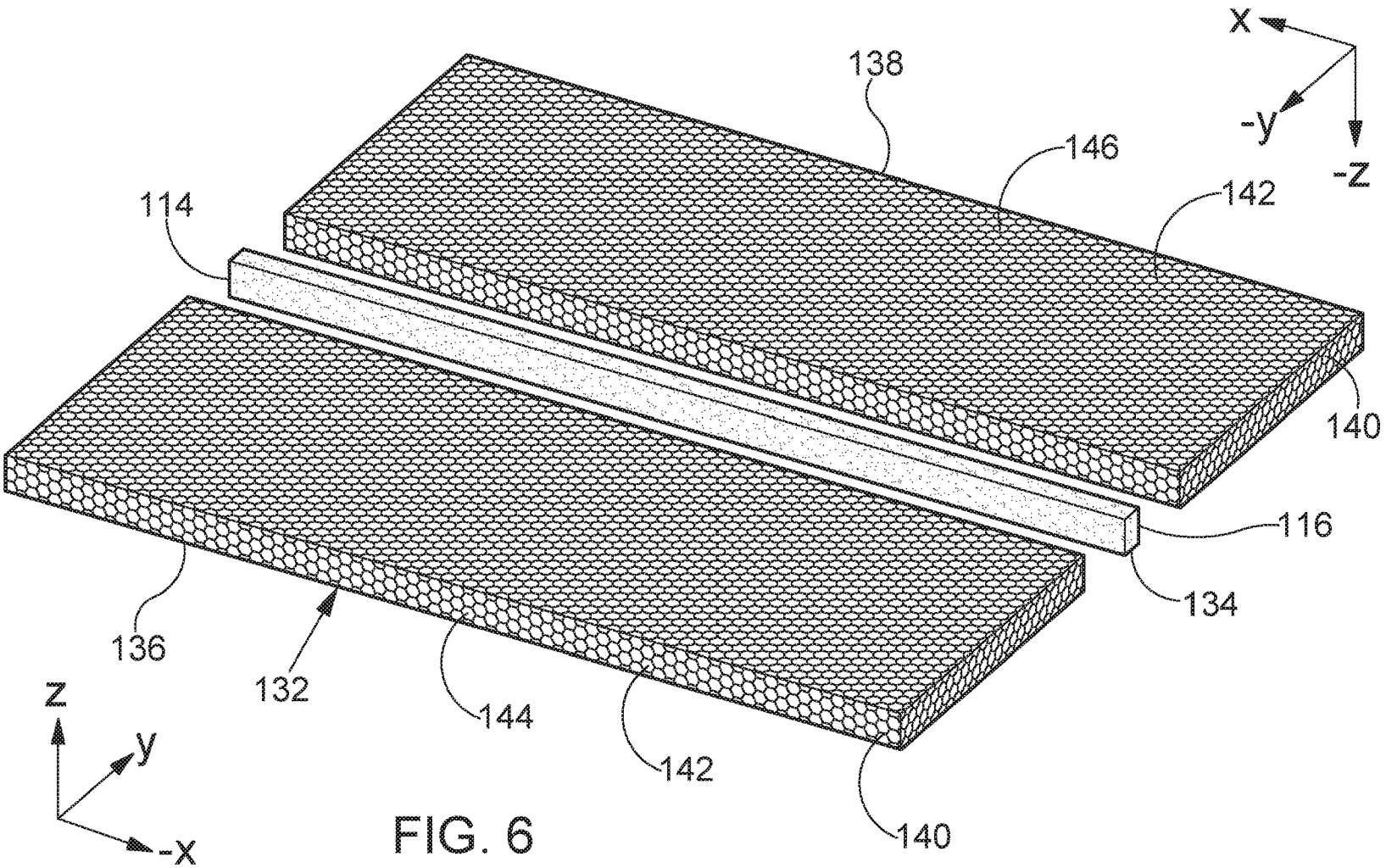
FIG. 6 is an exploded perspective view further illustrating the diffusing layer shown in FIG. 5.

FIG. 6 is an exploded perspective view further illustrating the diffusing layer 132 shown in FIG. 5.

Figure 7B:
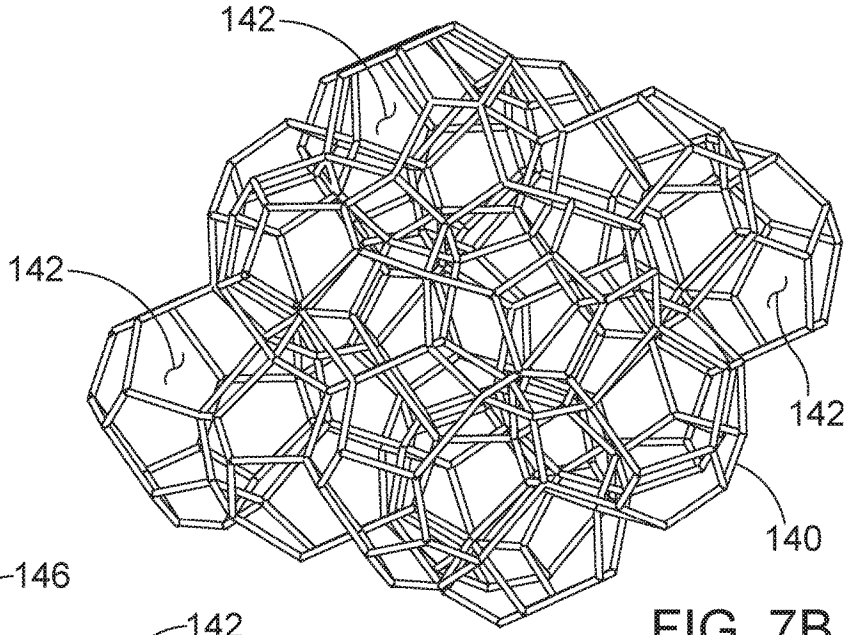
FIG. 7B is an enlarged perspective view further illustrating a portion of the cellular structure shown in FIG. 7A.
Figure 7A:
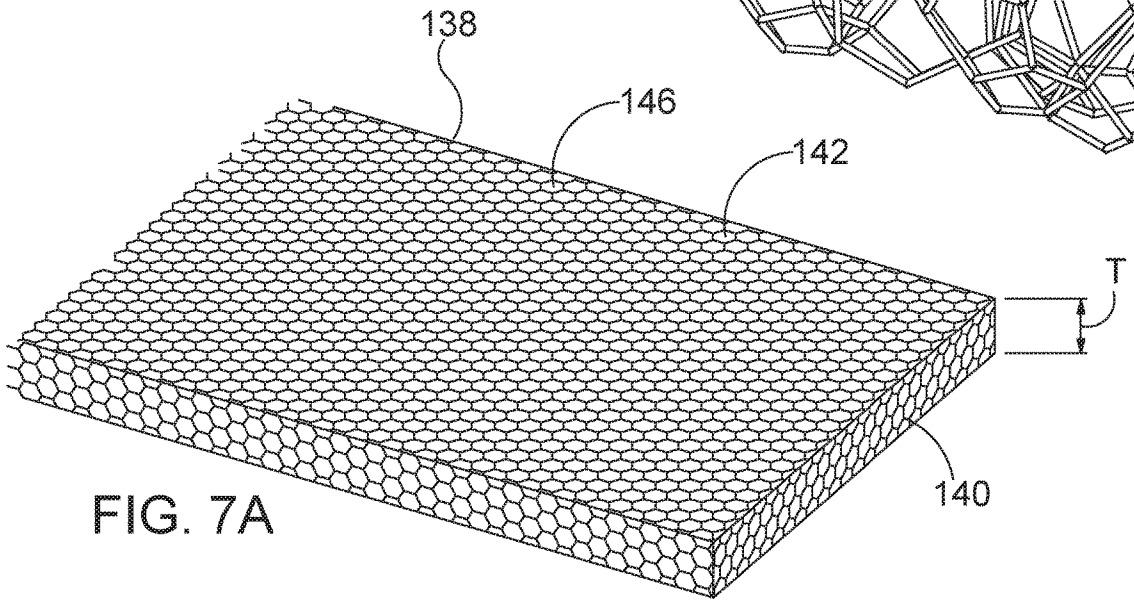
FIG. 7A is an enlarged perspective view further illustrating a portion of cellular structure of the starboard diffusing member shown in FIG. 5 and FIG. 6.

FIG. 7A is an enlarged perspective view further illustrating a portion of cellular structure 140 of the starboard diffusing member 138 shown in FIG. 5 and FIG. 6.

FIG. 7B is an enlarged perspective view further illustrating a portion of the cellular structure 140 shown in FIG. 7A. FIG. 8A is a perspective view showing a diffusing fabric 148.

Figure 8B:
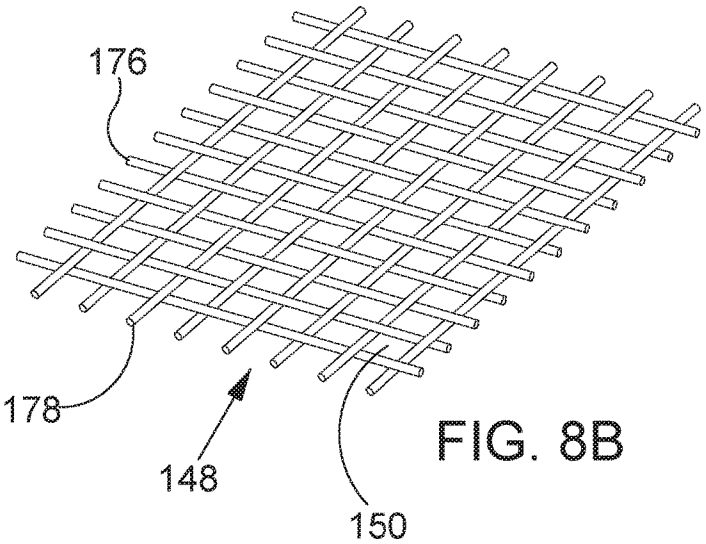
FIG. 8B is an enlarged perspective view further illustrating a portion of the diffusing fabric shown in FIG. 8A.
Figure 8A:
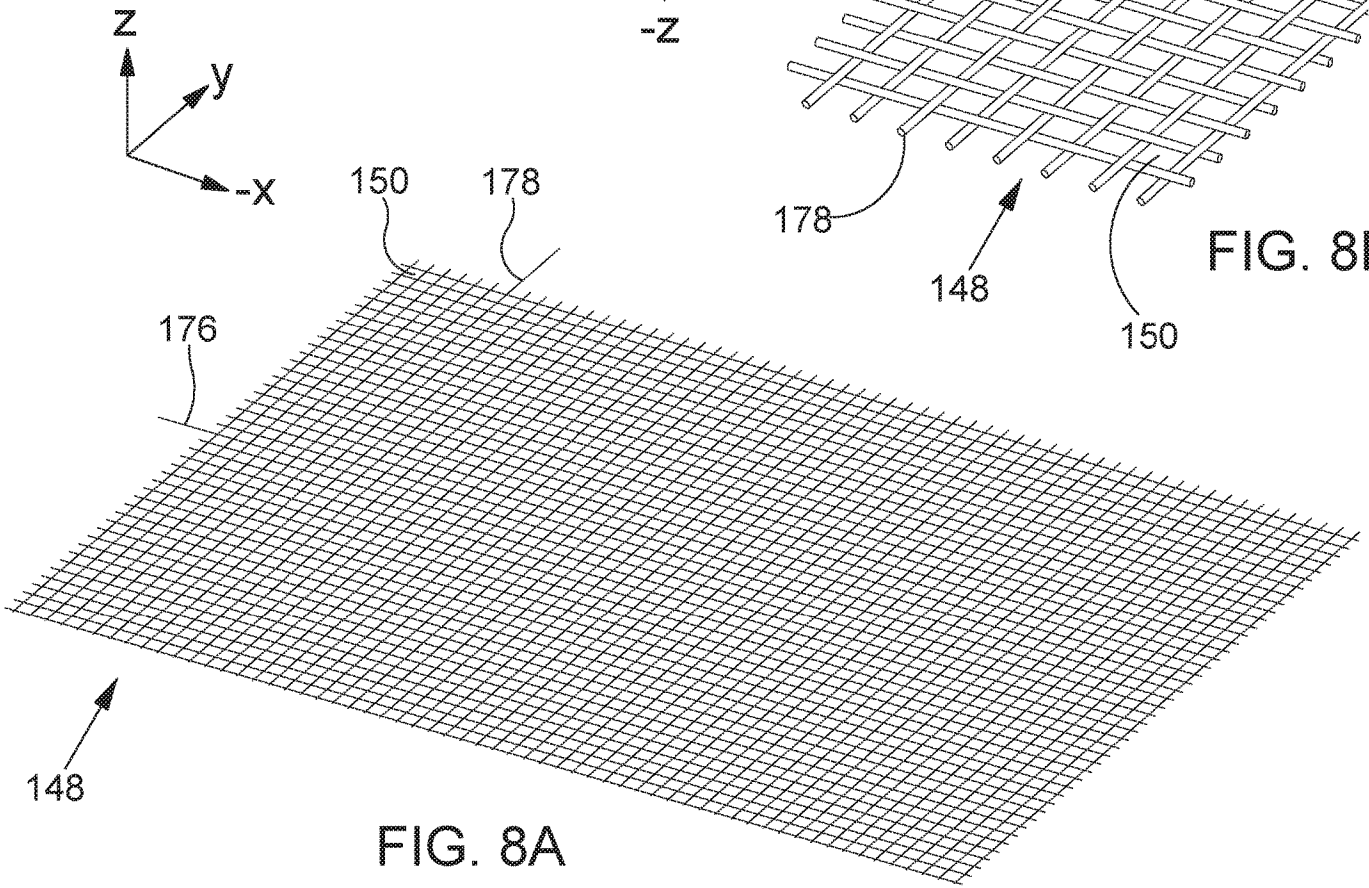
FIG. 8A is a perspective view showing a diffusing fabric.

FIG. 8B is an enlarged perspective view further illustrating a portion of the diffusing fabric 148 shown in FIG. 8A.

Figures 9A, 9B:
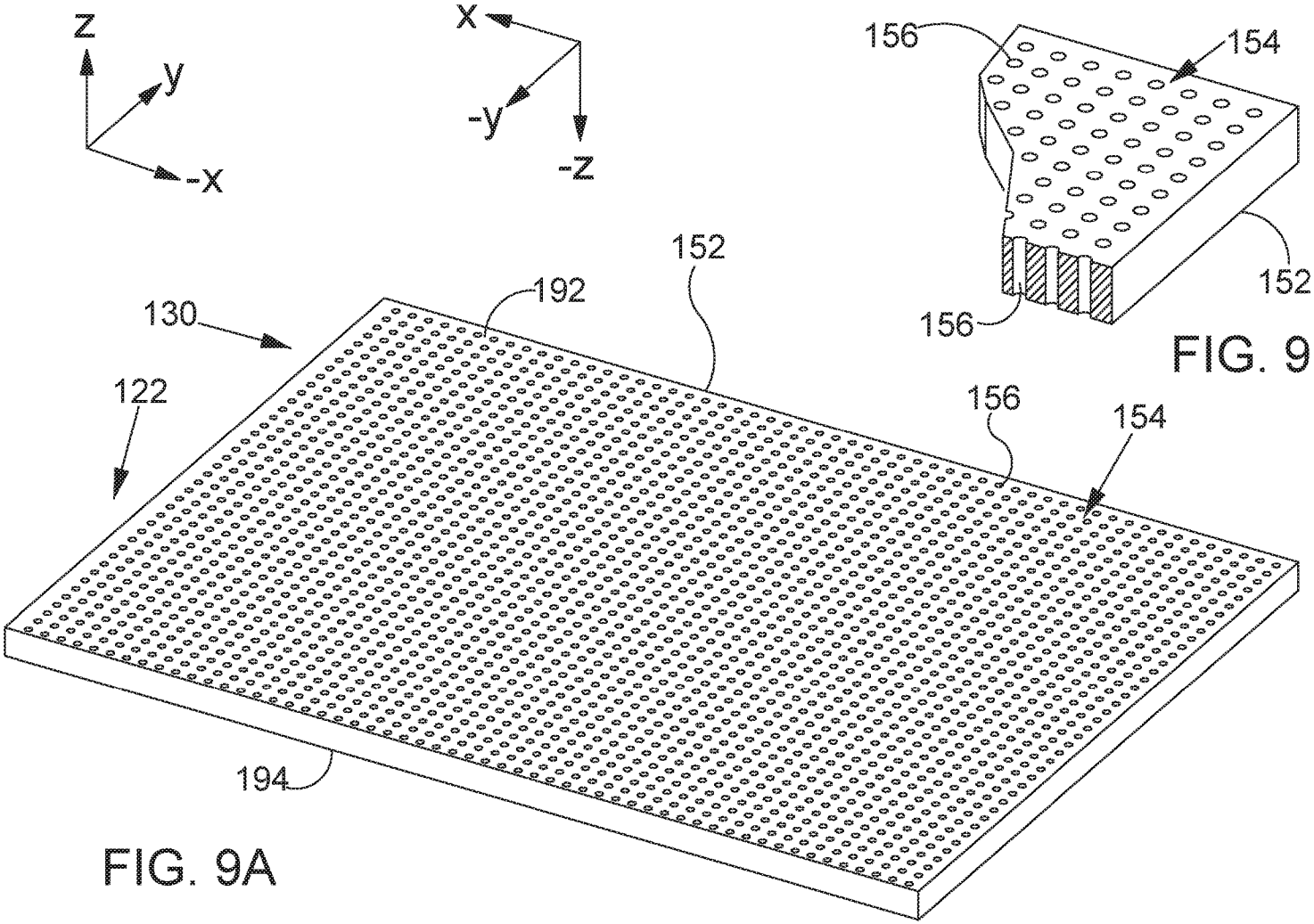
FIG. 9A is a perspective view showing a comfort layer.
FIG. 9B is an enlarged perspective view further illustrating a portion of the comfort layer shown in FIG. 9A.

FIG. 9A is a perspective view showing a comfort layer 152. FIG. 9B is an enlarged perspective view further illustrating a portion of the comfort layer 152 shown in FIG. 9A.

Figure 10:
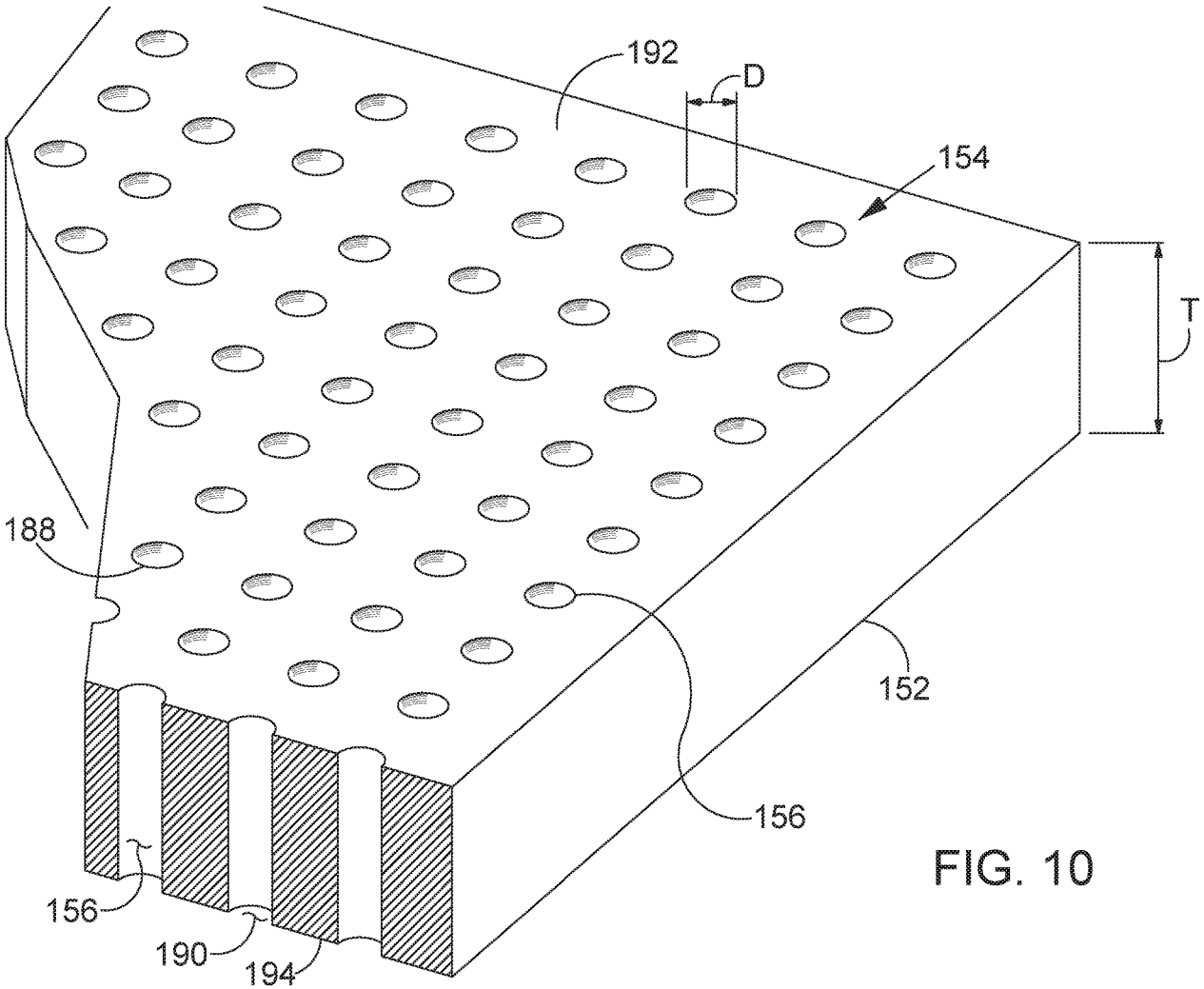
FIG. 10 is an enlarged perspective view further illustrating the comfort layer portion shown in FIG. 9B.

FIG. 10 is an enlarged perspective view further illustrating the comfort layer 152 portion shown in FIG. 9B.

Figure 12B:
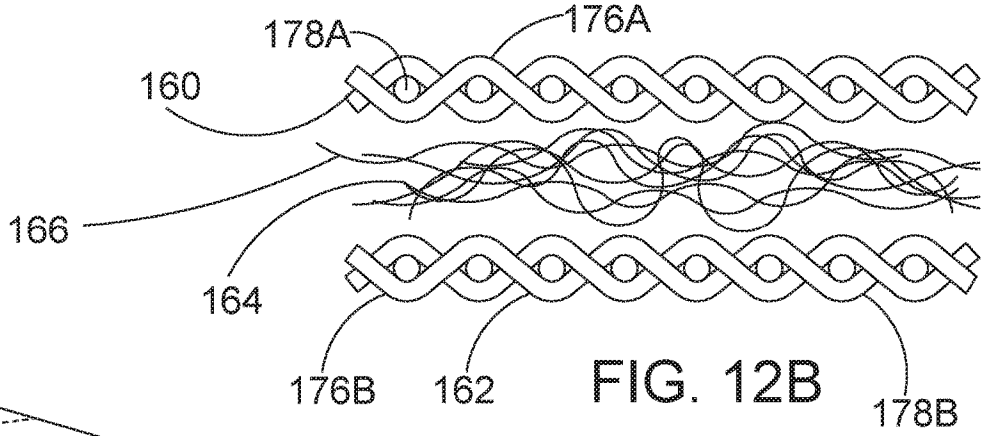
FIG. 12B is an enlarged perspective view further illustrating the cover layer portion shown in FIG. 12A.
Figure 12A:
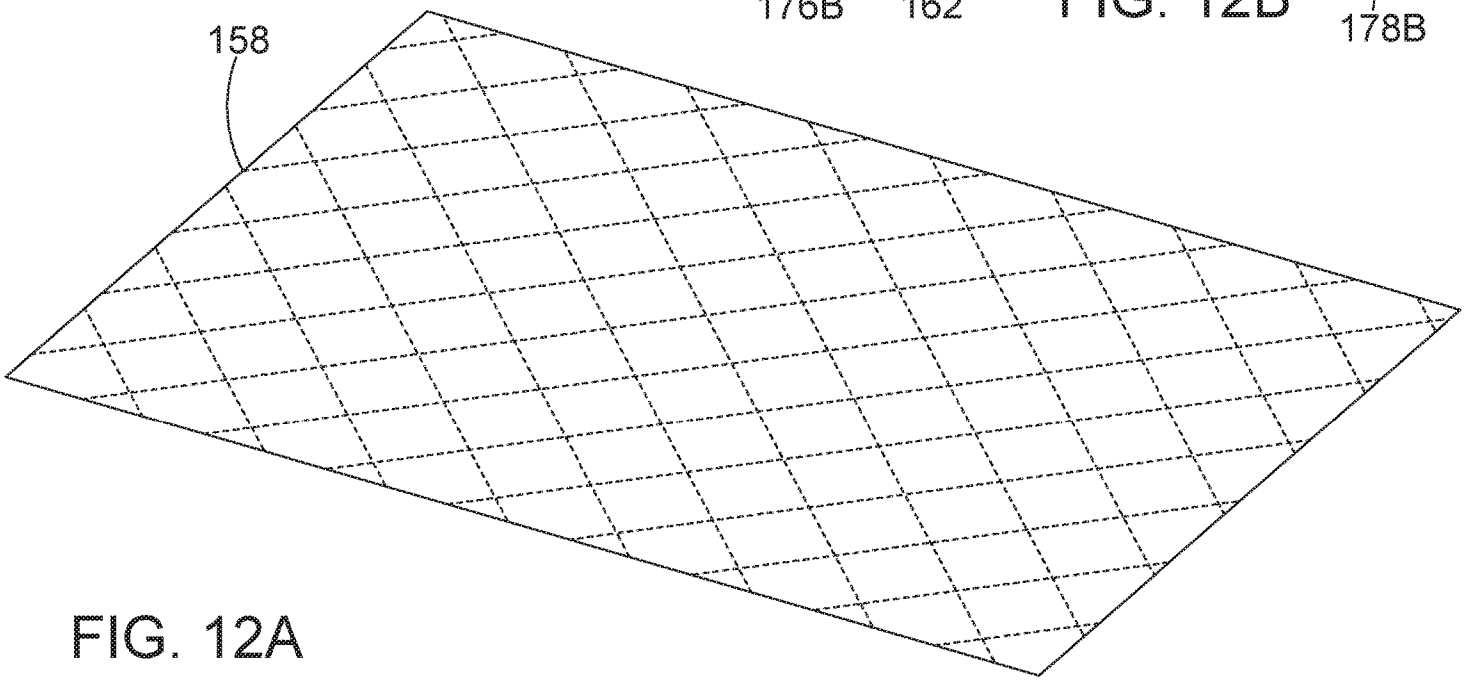
FIG. 12A is a perspective view showing a cover layer.

FIG. 11 is a stylized diagram illustrating an example air flow path 168. FIG. 12A is a perspective view showing a cover layer 158. FIG. 12B is an enlarged perspective view further illustrating the cover layer 158 portion shown in FIG. 12A.

FIG. 13 is an exploded perspective view showing a mattress 100 and a foundation 170.

Figure 14:
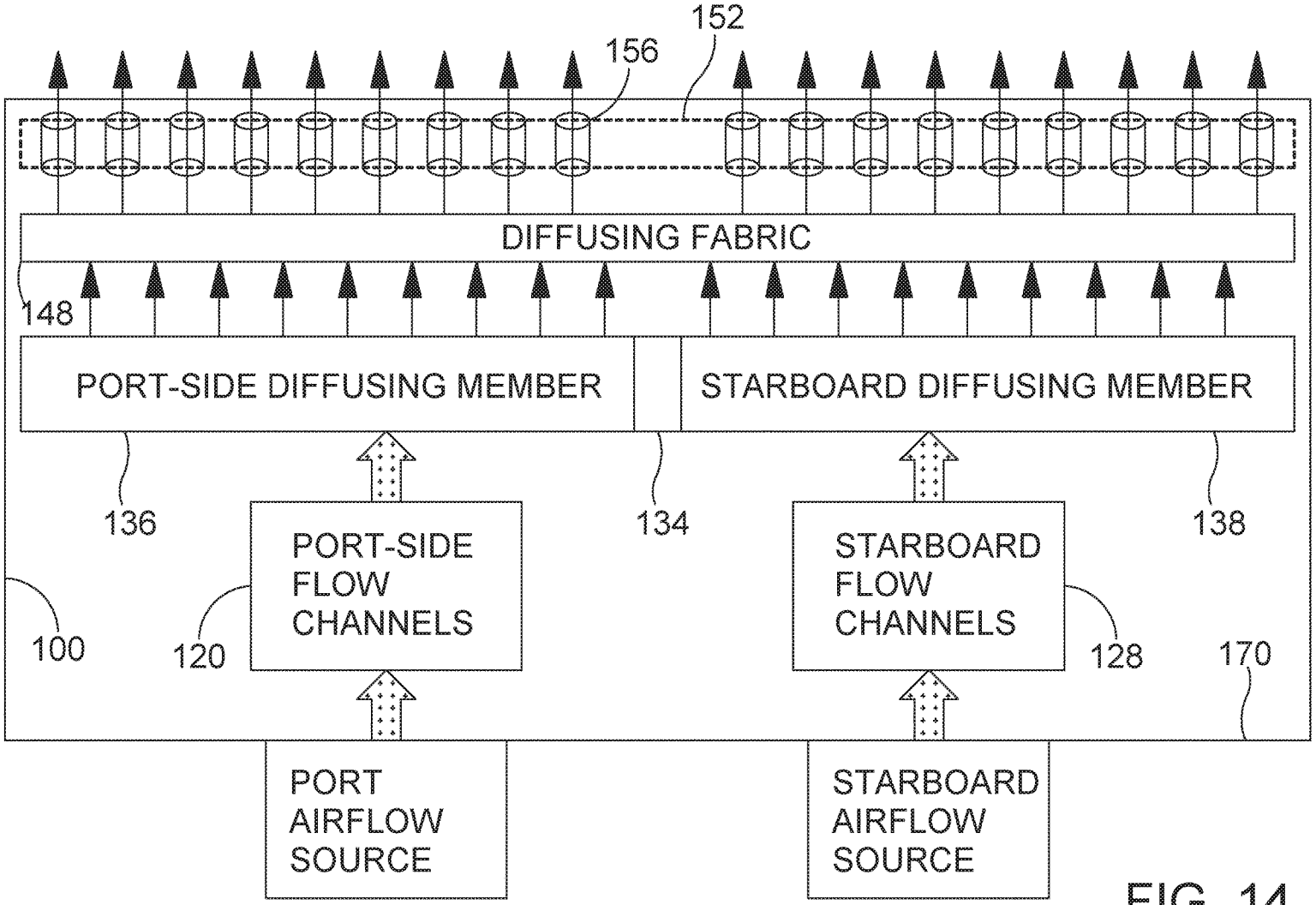
FIG. 14 is a stylized block diagram illustrating example air flow paths through a mattress structure.

FIG. 14 is a stylized block diagram illustrating example air flow paths through a mattress structure.

FIG. 15 is a perspective view of a base comprising a base layer and a transition layer that is bonded to the base layer by a layer of adhesive. In the embodiment of FIG. 15, one fabric patch of a diffusing fabric is positioned above each of the flow channels defined by the base. A diffusing layer 132 is shown with dashed lines in FIG. 15. In the embodiment of FIG. 15, the diffusing layer 132 is disposed between the fabric patches of diffusing fabric positioned above each of the flow channels defined by the base. In the embodiment of FIG. 15, the diffusing fabric comprises a plurality of fabric patches that do not span across a top surface of the diffusing layer.

FIG. 16 is a perspective view of a base comprising a base layer and a transition layer that is bonded to the base layer by a layer of adhesive. In the embodiment of FIG. 16, one fabric patch of a diffusing fabric is positioned above each of the flow channels defined by the base. A diffusing layer 132 also shown in FIG. 16. In the embodiment of FIG. 16, the diffusing layer 132 is disposed between the fabric patches of diffusing fabric positioned above each of the flow channels defined by the base. In the embodiment of FIG. 16, the diffusing fabric comprises a plurality of fabric patches that do not span across a top surface of the diffusing layer.

Referring to FIGS. 1-14, an upward direction Z and a downward or lower direction −Z are illustrated using arrows labeled "Z" and "−Z," respectively. A forward direction Y and a rearward direction −Y are illustrated using arrows labeled "Y" and "−Y," respectively. A starboard direction X and a port direction −X are illustrated using arrows labeled "X" and "−X," respectively. The directions illustrated using these arrows are applicable to the apparatus throughout this application. The port direction may also be referred to as the portward direction. In one or more embodiments, the upward direction is generally opposite the downward direction. In one or more embodiments, the upward direction and the downward direction are both generally orthogonal to an XY plane defined by the forward direction and the starboard direction. In one or more embodiments, the forward direction is generally opposite the rearward direction. In one or more embodiments, the forward direction and the rearward direction are both generally orthogonal to a ZY plane defined by the upward direction and the starboard direction. In one or more embodiments, the starboard direction is generally opposite the port direction. In one or more embodiments, starboard direction and the port direction are both generally orthogonal to a ZX plane defined by the upward direction and the forward direction. Various direction-indicating terms are used herein as a convenient way to discuss the objects shown in the figures. It will be appreciated that many direction indicating terms are related to the instant orientation of the object being described. It will also be appreciated that the objects described herein may assume various orientations without deviating from the spirit and scope of this detailed description. Accordingly, direction-indicating terms such as "upwardly," "downwardly," "forwardly," "backwardly," "portwardly," and "starboardly," should not be interpreted to limit the scope of the invention recited in the attached claims.

Referring to FIGS. 2 through 14, the mattress 100 comprises a base 102 including a base layer 104 and a transition layer 106 that is bonded to the base layer 104 by a layer of adhesive 108. In one or more embodiments, the base layer 104 comprises a polyurethane memory foam having a first density and the transition layer comprises a polyurethane memory foam having a second density that is less than the first density. In an embodiment, the base 102 defines a plurality of port-side flow channels 120 located in a port portion 122 of the base 102. In these embodiments, each of the port-side flow channels 120 extends in an upward direction from a bottom opening 182 in a bottom surface 124 of the base to a top opening 180 in a top surface 126 of the base and extends in a downward direction from the bottom opening 182 in the bottom surface 124 of the base 102 to the top opening 180 in the top surface 126 of the base 102. In an embodiment, the base 102 defines two or more starboard flow channels 128 located in a starboard portion 130 of the base 102. In these embodiments, each of the starboard flow channels 128 extends in an upward direction from a bottom opening 186 in a bottom surface 124 of the base to a top opening 184 in a top surface 126 of the base and extends in a downward direction from the bottom opening 186 in the bottom surface 124 of the base 102 to the top opening 184 in the top surface 126 of the base 102.

In an embodiment, a diffusing layer 132 overlays the top surface 126 of the base 102. In an embodiment, the diffusing layer 132 comprises a port diffusing member 136, a starboard diffusing member 138 and a dividing member 134 disposed between the port diffusing member 136 and the starboard diffusing member 138. The dividing member 134 has a forward end and a rearward end. In an embodiment, the dividing member 134 extends in a forward direction from the rearward end 116 to the forward end 114 and extends in a rearward direction from the forward end 114 to the rearward end 116. In an embodiment, the port diffusing member 136 comprises a cellular structure 140 defining a plurality of cells 142. In these embodiments, the cells 142 of the port diffusing member 136 fluidly communicate with each other to form a port volume 144 defined by the cellular structure 140 of the port diffusing member 136. The port volume 144 is in fluid communication with the port-side flow channels 120 in an embodiment. In an embodiment, the starboard diffusing member 138 comprising a cellular structure 140 defining a plurality of cells 142. In these embodiments, the cells 142 of the starboard diffusing member 138 fluidly communicate with each other to form a starboard volume 146 defined by the cellular structure 140 of the starboard diffusing member 138. The starboard volume 146 is in fluid communication with the starboard flow channels 128 in an embodiment. In an embodiment, the dividing member 134 comprises a closed cell foam material disposed between the port diffusing member 136 and the starboard diffusing member 138 so that the port volume 144 is not in fluid communication with the starboard volume 146 via the dividing member 134. In an embodiment, the dividing member 134 has a length, a width and a height, the length being greater than the height, the height being greater than the width.

The mattress 100 may further include a diffusing fabric 148 overlaying the diffusing layer 132 in some embodiments. In an embodiment, the diffusing fabric 148 comprises a plurality of warp fibers 176 and a plurality of weft fibers 178. In an embodiment, each of the warp fibers 176 extends in forward and rearward directions and each of the weft fibers extend in porward and starboard directions. The fibers of the diffusing fabric 148 define a multiplicity of connected interstitial spaces 150 and the interstitial spaces 150 allow air to flow through the diffusing fabric x in some embodiments.

The mattress 100 may further include a comfort layer 152 overlaying the diffusing fabric 148 in some embodiments. In an embodiment, the comfort layer 152 comprising a Talalay latex foam having a thickness dimension with a value between 1 inch and 3 inches. In an embodiment, the comfort layer 152 defines a plurality of bore holes 156. In an embodiment, each of the bore holes 156 extends in an upward direction from a lower opening 190 in a lower surface 194 of the comfort layer 152 to an upper opening 188 in an upper surface 192 of the comfort layer 152 and extends in a downward direction from the lower opening 190 in the lower surface 194 of the comfort layer to the upper opening 188 in the upper surface 192 of the comfort layer 152.

In an embodiment, each of the bore holes 156 defined by a port part 112 of the comfort layer 152 fluidly communicates with the port volume 144 defined by the port diffusing member 136 via interstitial spaces 150 defined by the diffusing fabric 148. Also in an embodiment, each of the bore holes defined by a starboard part 110 of the comfort layer 152 fluidly communicates with the starboard volume 146 defined by the starboard diffusing member 138 via interstitial spaces 150 defined by the diffusing fabric 148.

The mattress 100 may further include a cover layer 158 overlaying the comfort layer 152 in some embodiments. In an embodiment, the cover layer 158 comprises a first woven fabric 160, a second woven fabric 162 and a plurality of non-woven fibers 166 disposed between the first woven fabric 160 and the second woven fabric 162. In an embodiment, the first woven fabric 160 comprising a plurality of woven fibers that are coated with a phase changing gel material.

Referring to FIGS. 1 through 16, it will be appreciated that the mattress 100 defines a plurality of port-side airflow paths 168 and starboard airflow paths 168 extending through the mattress 100. In an embodiment, each of the port-side airflow paths 168 extend through a port-side flow channels 120 defined by the base 102, the port volume 144 defined by the cellular structure 140 of the port diffusing member 136, the interstitial spaces 150 defined by the diffusing fabric 148, and a bore holes 156 defined by the port part 112 of the comfort layer 152. In an embodiment, each of the starboard airflow paths 168 extends through a starboard flow channels 128 defined by the base 102, the starboard volume 146 defined by the cellular structure 140 of the starboard diffusing member 138, the interstitial spaces 150 defined by the diffusing fabric 148, and a bore holes 156 defined by the starboard portion 130 of the comfort layer 152.

In one or more embodiments, the cover layer 158 of a mattress 100 comprises a first woven fabric 160, a second woven fabric 162, and a plurality of non-woven fibers 166 disposed between the first woven fabric 160 and the second woven fabric 162. In one or more embodiments, the first woven fabric 160 comprises a plurality of warp fibers 176A and a plurality of weft fibers 178A. In one or more embodiments, each of the warp fibers 176A extends in forward and rearward directions and each of the weft fibers 178A extend in porward and starboard directions. In one or more embodiments, the second woven fabric 162 comprises a plurality of warp fibers 176B and a plurality of weft fibers 178B. In one or more embodiments, each of the warp fibers 176B extends in forward and rearward directions and each of the weft fibers 178B extend in porward and starboard directions. In one or more embodiments, the first woven fabric 160 is coated with a phase changing material. In one or more embodiments, the weft fibers 178A, the weft fibers 178B, the warp fibers 176A, the warp fibers 176B, and/or the non-woven fibers 166 are coated with a material having phase changing characteristics. Examples of coating materials having phase changing characteristics that may be suitable in some applications are described in the following United States patents, all of which are hereby incorporated by reference herein: U.S. Pat. Nos. 5,366,801, 6,207,738, and 6,514,362.

In one or more embodiments, the weft fibers 178A and the warp fibers 176B of the first woven fabric 160 comprise fibers having phase changing characteristics. In one or more embodiments, the weft fibers 178A, the weft fibers 178B, the warp fibers 176A, the warp fibers 176B, and/or the non-woven fibers 166 comprise fibers having phase changing characteristics. Examples of fibers having phase changing characteristics that may be suitable in some applications are described in the following United States Patents, all of which are hereby incorporated by reference herein: U.S. Pat. Nos. 4,756,958, 5,885,475, 7,666,500, and 8,679,627.

FIG. 15 is a perspective view of a base comprising a base layer and a transition layer that is bonded to the base layer by a layer of adhesive. In the embodiment of FIG. 15, one fabric patch of a diffusing fabric is positioned above each of the flow channels defined by the base. A diffusing layer 132 is shown with dashed lines in FIG. 15. In the embodiment of FIG. 15, the diffusing layer 132 is disposed between the fabric patches of diffusing fabric positioned above each of the flow channels defined by the base. In the embodiment of FIG. 15, the diffusing fabric comprises a plurality of fabric patches that do not span across a top surface of the diffusing layer.

FIG. 16 is a perspective view of a base comprising a base layer and a transition layer that is bonded to the base layer by a layer of adhesive. In the embodiment of FIG. 16, one fabric patch of a diffusing fabric is positioned above each of the flow channels defined by the base. A diffusing layer 132 also shown in FIG. 16. In the embodiment of FIG. 16, the diffusing layer 132 is disposed between the fabric patches of diffusing fabric positioned above each of the flow channels defined by the base. In the embodiment of FIG. 16, the diffusing fabric comprises a plurality of fabric patches that do not span across a top surface of the diffusing layer.

Referring to FIGS. 1 through 16, a system in accordance with this detailed description may comprise a mattress 100 and a foundation 170. The mattress may work in conjunction with a port side temperature controlled air flow source providing a first flow of air having a first temperature. The mattress may also work in conjunction with a starboard side temperature controlled air flow source providing a second flow of air having a second temperature. The mattress may define a first plurality of air flow paths configured to direct the first flow of air toward a first occupant of the mattress and a second plurality of air flow paths configured to direct the second flow of air toward a second occupant of the mattress. Examples of temperature controlled airflow sources that may be suitable in some applications are described in the following United States Patents, all of which are hereby incorporated by reference herein: U.S. Pat. Nos. 7,877,827, 7,996,936, 8,065,763, 8,181,290, 8,191,187, 8,402,579, 8,418,286, 8,732,874, 8,782,830, 8,893,329, and 9,125,497.

Referring to FIGS. 1 through 16, a mattress in accordance with this detailed description may comprise a port diffusing member and a starboard diffusing member. The port diffusing member comprising a cellular structure defining a plurality of cells, the cells of the port diffusing member fluidly communicating with each other to form a port volume defined by the cellular structure of the port diffusing member, the port volume being in fluid communication with the port flow channels defined by the base of the mattress. The starboard diffusing member comprising a cellular structure defining a plurality of cells, the cells of the starboard diffusing member fluidly communicating with each other to form a starboard volume defined by the cellular structure of the starboard diffusing member, the starboard volume being in fluid communication with the starboard flow channels defined by the base of the mattress. In one or more embodiments, the cellular structure of the port diffusing member comprises a reticulated polyurethane foam structure. In one or more embodiments, the cellular structure of the starboard diffusing member comprises a reticulated polyurethane foam structure. Reticulated foam materials that may be suitable in some applications are described in the following United States patents, all of which are hereby incorporated by reference herein: U.S. Pat. Nos. 3,171,820, 3,390,106, 3,475,525, and 4,579,700.

The following United States patents are hereby incorporated by reference herein:

U.S. Pat. Nos. 9,192,245, 9,211,017, 6,052,853, 6,336,237, 6,370,718, 7,037,188, 7,127,763, 9,265,352, 7,240,386, 8,997,279, 7,334,280, 7,914,611, 8,372,182, 8,881,328, 8,918,930, 9,138,064, 9,211,017, 7,877,827, 7,996,936, 8,065,763, 8,181,290, 8,191,187, 8,332,975, 8,402,579, 8,408,012, 8,418,286, 8,424,315, 8,424,314, 8,621,687, 8,732,874, 8,782,830, 8,893,329, 9,121,414, 9,125,497, and RE44272. These United States patents are incorporated by reference for all purposes. Such purposes may include, by way of example and not limitation, the purposes described in MPEP section 2163.07(B). For example, components illustrated in these patents may be utilized with embodiments described in this detailed description.

The United States patents mentioned in all sections of this patent application are hereby incorporated by references in their entirety for all purposes.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A mattress for placement on a foundation that has forced air ventilation with a plurality of air vents on the upwardly facing side of the foundation, the mattress configured to permit air from the air vents to pass through the mattress, the mattress comprising:

a base comprising a port portion and a starboard portion, the port portion defining a plurality of port-side flow channels and the starboard portion defining a plurality of starboard flow channels, each flow channel extending in an upward direction from an opening in a bottom surface of the base to an opening in a top surface of the base;

a diffusing layer overlaying the top surface of the base, the diffusing layer comprising a port diffusing member, a starboard diffusing member and a dividing member disposed between the port diffusing member and the starboard diffusing member, the dividing member having a forward end and a rearward end, the dividing member extending in a forward direction from the rearward end to the forward end;

the port diffusing member comprising a cellular structure defining a plurality of cells, the cells of the port diffusing member fluidly communicating with each other to form a port volume defined by the cellular structure of the port diffusing member, the port volume being in fluid communication with the port flow channels;

the starboard diffusing member comprising a cellular structure defining a plurality of cells, the cells of the starboard diffusing member fluidly communicating with each other to form a starboard volume defined by the cellular structure of the starboard diffusing member, the starboard volume being in fluid communication with the starboard flow channels;

the dividing member comprising a closed cell foam material disposed between the port diffusing member and the starboard diffusing member so that the port volume is not in fluid communication with the starboard volume via the dividing member, the dividing member having a length, a width and a height, the length being greater than the height, the height being greater than the width;

a diffusing fabric overlaying the diffusing layer, the diffusing fabric comprising a plurality of warp fibers and a plurality of weft fibers, each warp fiber extending in forward and rearward directions, each weft fiber extending in portward and starboard directions, the fibers of the diffusing fabric defining a multiplicity of connected interstitial spaces, the interstitial spaces allowing air to flow through the diffusing fabric;

a comfort layer overlaying the diffusing fabric, the comfort layer defining a plurality of bore holes, each bore hole extending in an upward direction from an opening in a bottom surface of the comfort layer to an opening in a top surface of the comfort layer, and extending in a downward direction from the opening in the bottom surface of the comfort layer to the opening in the top surface of the comfort layer;

each bore hole defined by a port portion of the comfort layer fluidly communicating with the port volume defined by the port diffusing member via interstitial spaces defined by the diffusing fabric;

each bore hole defined by a starboard portion of the comfort layer fluidly communicating with the starboard volume defined by the starboard diffusing member via interstitial spaces defined by the diffusing fabric;

wherein the mattress defines a plurality of port-side air flow paths extending there through, each port-side airflow path extending through a port airflow channel defined by the base, the port volume defined by the cellular structure of the port diffusing member, the interstitial spaces defined by the diffusing fabric, and a bore hole defined by the port portion of the comfort layer; and wherein the mattress defines a plurality of starboard-side air flow paths extending there through, each starboard-side airflow path extending through a starboard airflow channels defined by the base, the starboard volume defined by the cellular structure of the starboard diffusing member, the interstitial spaces defined by the diffusing fabric, and a bore hole defined by the starboard portion of the comfort layer.

2. The mattress of claim 1, wherein the base comprising a base layer and a transition layer bonded to the base layer by a layer of adhesive, the base layer comprising a polyurethane memory foam having a first density and the transition layer comprising a polyurethane memory foam having a second density that is less than the first density.

3. The mattress of claim 1, further comprising a cover layer overlaying the comfort layer, the cover layer comprising a first woven fabric, a second woven fabric, and a plurality of non-woven fibers disposed between the first woven fabric and the second woven fabric, the first woven fabric comprising a plurality of woven fibers, and the first woven fabric being coated with a phase changing gel material.

4. The mattress of claim 1, wherein the diffusing fabric is less than ⅛ inches thick.

5. The mattress of claim 1, wherein the comfort layer has a thickness of from 1 to 4 inches think and the bore holes are arranged in a matrix with the bore holes spaced from each other ¾ to 2 ½ inches apart.

6. The mattress of claim 1, wherein wherein the diffusing fabric piece has sufficient density to force air from the air duct ports around the fabric while allowing some air to pass through the diffusing fabric piece.

7. The mattress of claim 1, wherein the comfort layer comprises a Talalay latex foam.

8. The mattress of claim 7, wherein the Talalay latex foam of the comfort layer comprises a closed cell foam material.

9. The mattress of claim 6, wherein the the exterior cover layer comprises a fabric with a phase changing material.

10. The mattress of claim 1, wherein the comfort layer comprises a closed cell foam material.

11. The mattress of claim 1, wherein the diffusing fabric spans continuously across a top surface of the diffusing layer.

12. The mattress of claim 1, wherein the diffusing layer extends continuously across the top surface of the base.

13. The mattress of claim 1, wherein the cellular structure of the port diffusing member comprises a reticulated polyurethane foam structure.

14. The mattress of claim 1, wherein the cellular structure of the starboard diffusing member comprises a reticulated polyurethane foam structure.

15. A mattress for use with a foundation, the foundation comprising a hollow box structure with an upwardly facing support surface with a plurality of forced air duct ports, the foundation having temperature control units for providing the forced air out of the ducts, the mattress comprising:

a base formed of memory foam defining a plurality of air flow channels positioned to cooperate with the plurality of forced air duct ports of the foundation, each air flow channel extending in an upward direction from an opening in a bottom surface of the base to an opening in a top surface of the base whereby forced air from the plurality of air duct ports is forced through the plurality of air flow channels;

a diffusing member disposed above the base, the diffusing member comprising a foam with an open cellular structure defining a plurality of interconnected open cells, whereby the cells of the diffusing member fluidly communicating with each other, the open cellular structure overlaying the openings in the top surface of the base;

comfort layer disposed above the diffusing member, the comfort layer comprising a foam layer with a plurality of bore holes, each bore hole extending in an upward direction from an opening in a bottom surface of the comfort layer to an opening in a top surface of the comfort layer; and an exterior cover layer enclosing the base, the diffusing member, the comfort layer;

wherein the base is formed of two layers of memory foam, the layers having different characteristics from each other.

16. The mattress of claim 15 wherein the comfort layer has a thickness of from 1 to 4 inches think and the bore holes are arranged in a matrix with the bore holes spaced from each other ¾ to 2½ inches apart.

17. The mattress of claim 15 wherein the exterior cover layer comprises a fabric with a phase changing material.

18. A mattress for use with a foundation, the foundation comprising a hollow box structure with an upwardly facing support surface with a plurality of forced air duct ports, the foundation having temperature control units for providing the forced air out of the ducts, the mattress comprising:

a base formed of memory foam defining a plurality of air flow channels positioned to cooperate with the plurality of forced air duct ports of the foundation, each air flow channel extending in an upward direction from an opening in a bottom surface of the base to an opening in a top surface of the base whereby forced air from the plurality of air duct ports is forced through the plurality of air flow channels;

a diffusing member disposed above the base, the diffusing member comprising a foam with an open cellular structure defining a plurality of interconnected open cells, whereby the cells of the diffusing member fluidly communicating with each other, the open cellular structure overlaying the openings in the top surface of the base;

comfort layer disposed above the diffusing member, the comfort layer comprising a foam layer with a plurality of bore holes, each bore hole extending in an upward direction from an opening in a bottom surface of the comfort layer to an opening in a top surface of the comfort layer; and an exterior cover layer enclosing the base, the diffusing member, the comfort layer;

wherein a diffusing fabric piece is positioned intermediate the diffusing member and the comfort layer, the diffusing fabric piece being localized to regions spaced from edges of the diffusing member and positioned above the forced air duct ports of the foundation.

19. The mattress of claim 18 wherein the diffusing fabric piece has sufficient density to force air from the air duct ports around the fabric while allowing some air to pass through the diffusing fabric piece.

20. The mattress of claim 19 wherein the diffusing fabric is less than ⅛ inches thick.

* * * * *